US010443278B1

(12) United States Patent
Moody

(10) Patent No.: US 10,443,278 B1
(45) Date of Patent: Oct. 15, 2019

(54) GATE LIFTER LATCH

(71) Applicant: John C. Moody, Jacksonville Beach, FL (US)

(72) Inventor: John C. Moody, Jacksonville Beach, FL (US)

( * ) Notice: Subject to any disclaimer, the term of this patent is extended or adjusted under 35 U.S.C. 154(b) by 0 days.

(21) Appl. No.: 16/353,342

(22) Filed: Mar. 14, 2019

(51) Int. Cl.
*E05C 19/00* (2006.01)
*E05C 3/14* (2006.01)

(52) U.S. Cl.
CPC ..... *E05C 19/009* (2013.01); *E05C 3/14* (2013.01); *E05Y 2800/406* (2013.01); *E05Y 2900/40* (2013.01); *Y10S 292/29* (2013.01); *Y10T 292/108* (2015.04); *Y10T 292/1043* (2015.04); *Y10T 292/1063* (2015.04); *Y10T 292/68* (2015.04)

(58) Field of Classification Search
CPC ..... Y10S 292/29; Y10S 292/60; Y10T 292/1043; Y10T 292/108; Y10T 292/1063; Y10T 292/1064; Y10T 292/107; Y10T 292/68; E05C 19/009
See application file for complete search history.

(56) References Cited

U.S. PATENT DOCUMENTS 126,191 A * 4/1872 Dickey ..... E05F 11/00 292/238
134,877 A * 1/1873 Finley ..... E05F 11/00 292/238
193,678 A * 7/1877 Unger ..... E05F 11/00 292/238
277,807 A * 5/1883 Stovall ..... E05B 65/0811 292/128
633,008 A * 9/1899 Jeffers ..... E05F 11/00 292/238
797,485 A * 8/1905 Zanders ..... E05B 65/0811 292/128
844,907 A * 2/1907 Aikin ..... E05B 15/0093 292/136
1,204,228 A * 11/1916 Zanders ..... E05B 65/0811 292/128
1,570,734 A 1/1926 Eversman
2,211,963 A * 8/1940 Strid ..... E05C 17/50 292/101
2,746,783 A * 5/1956 Rader ..... E05B 15/022 292/173
2,767,006 A * 10/1956 Patrick ..... E05C 17/50 292/127
2,838,334 A 6/1958 Cornwell, Jr. et al.
3,023,451 A * 3/1962 Thoel ..... B62D 33/0273 16/258

(Continued)

*Primary Examiner* — Carlos Lugo
(74) *Attorney, Agent, or Firm* — Thomas C. Saitta

(57) ABSTRACT

A gate lifter latch having a striker assembly having a striker pin, the striker assembly mounted to the free end of a gate, and a catch lifting assembly mounted to a latch post, the catch lifting assembly having a pivoting lift arm that receives a striker pin, such that during closure of the gate the pivoting lift arm pivots upward and raises the striker pin and free end of the gate. The gate lifter latch may further have a manual or automatic gate latch assembly for securement of the gate in the closed position. The components of the gate lifter latch are preferably structured such that the gate lifter latch may be disassembled and reassembled for use with either a left or right inswing or outswing gate.

17 Claims, 32 Drawing Sheets

(56) References Cited

U.S. PATENT DOCUMENTS 3,244,830 A * 4/1966 Bates ..... A47L 15/4259 200/61.68
4,451,072 A * 5/1984 Petty, Sr. ..... E05C 3/14 292/104
4,690,440 A * 9/1987 Rogers ..... E05B 65/0007 292/205
4,799,720 A 1/1989 Watson et al.
4,871,203 A 10/1989 Rogers
4,887,854 A * 12/1989 Bulten ..... E05C 3/14 292/238
5,069,491 A * 12/1991 Weinerman ..... E05B 77/265 292/216
5,116,090 A * 5/1992 Nichandros ..... E05B 53/00 292/205
5,498,041 A * 3/1996 Bezzerides ..... E05B 15/022 292/225
5,716,041 A * 2/1998 Groves ..... E06B 11/02 256/24
6,176,043 B1 * 1/2001 Gibbs ..... E05B 9/08 49/449
6,247,733 B1 6/2001 Weiland
6,390,518 B1 * 5/2002 Elick ..... A47L 15/4259 292/117
6,471,261 B1 * 10/2002 Messler ..... E05B 65/0007 292/205
6,679,530 B2 * 1/2004 Krynski ..... E05B 65/0007 292/210
7,029,043 B2 * 4/2006 Fisher ..... E05B 15/0006 292/341.13
7,210,711 B2 * 5/2007 Dirnberger ..... A47L 15/4259 292/223
7,347,460 B2 * 3/2008 Ala ..... A47L 15/4259 292/216
7,938,458 B1 * 5/2011 Zweibohmer ..... E05B 15/0006 292/197
7,959,194 B2 * 6/2011 Mahoney ..... E05B 53/003 292/121
8,308,205 B2 * 11/2012 Tejszerski ..... E05B 65/0007 292/230
8,544,149 B1 10/2013 Faber
8,678,451 B2 * 3/2014 Martin ..... E05C 3/14 292/121
9,107,560 B2 * 8/2015 Bauriedl ..... A47L 15/4259
9,267,315 B2 * 2/2016 Lee ..... D06F 39/14
2010/0148523 A1 * 6/2010 Tai ..... E05B 17/2038 292/236

* cited by examiner

Fig. 9A
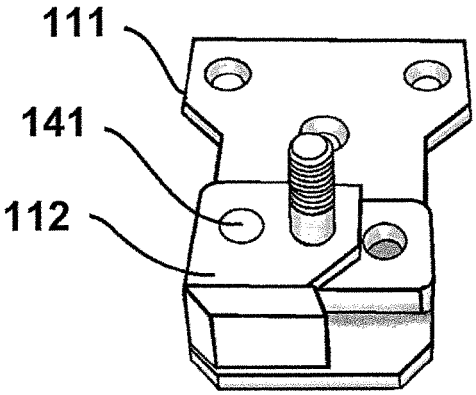
Fig. 9B
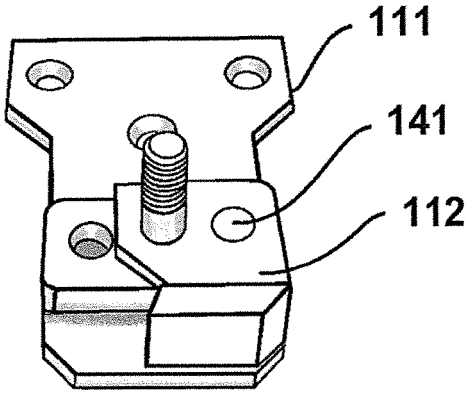
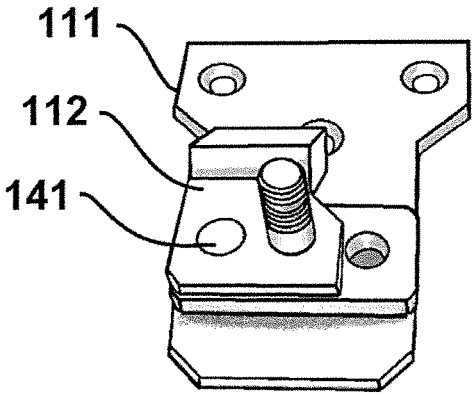
Fig. 9C
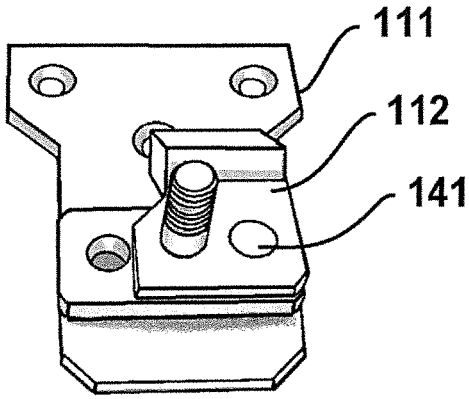
Fig. 9D

Fig. 10A
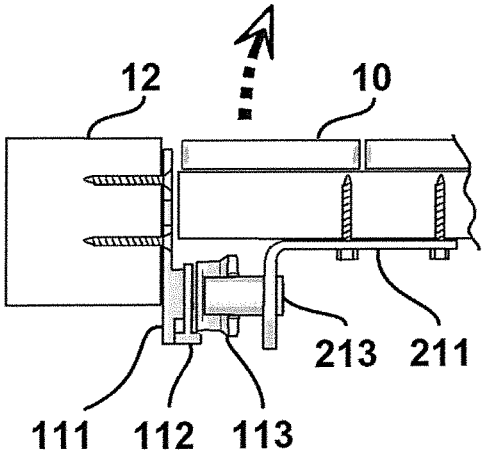
Fig. 10B
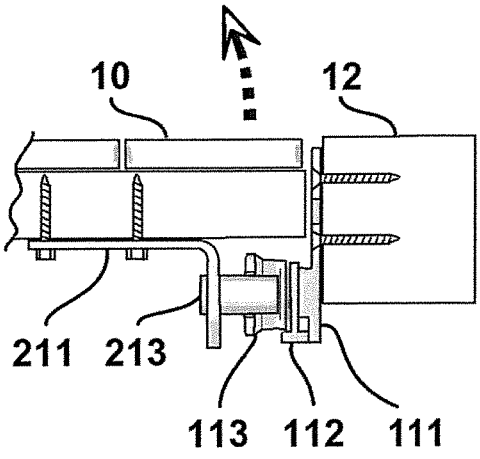
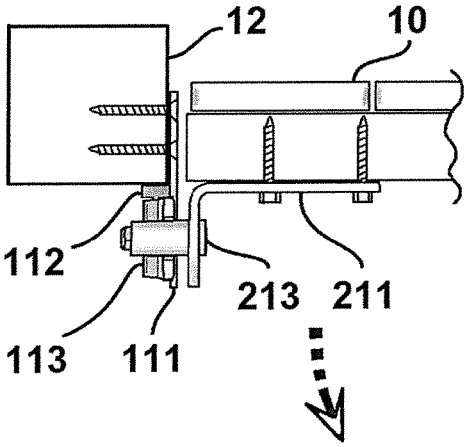
Fig. 10C
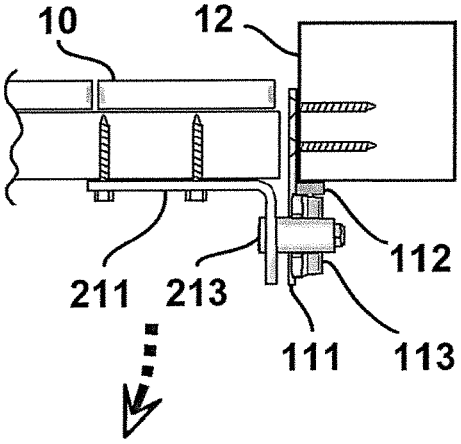
Fig. 10D

Fig. 11A
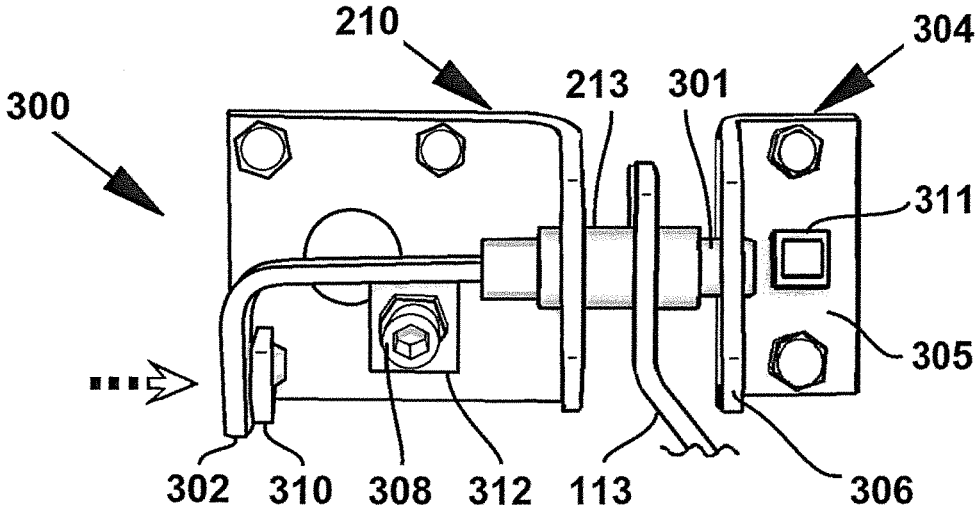
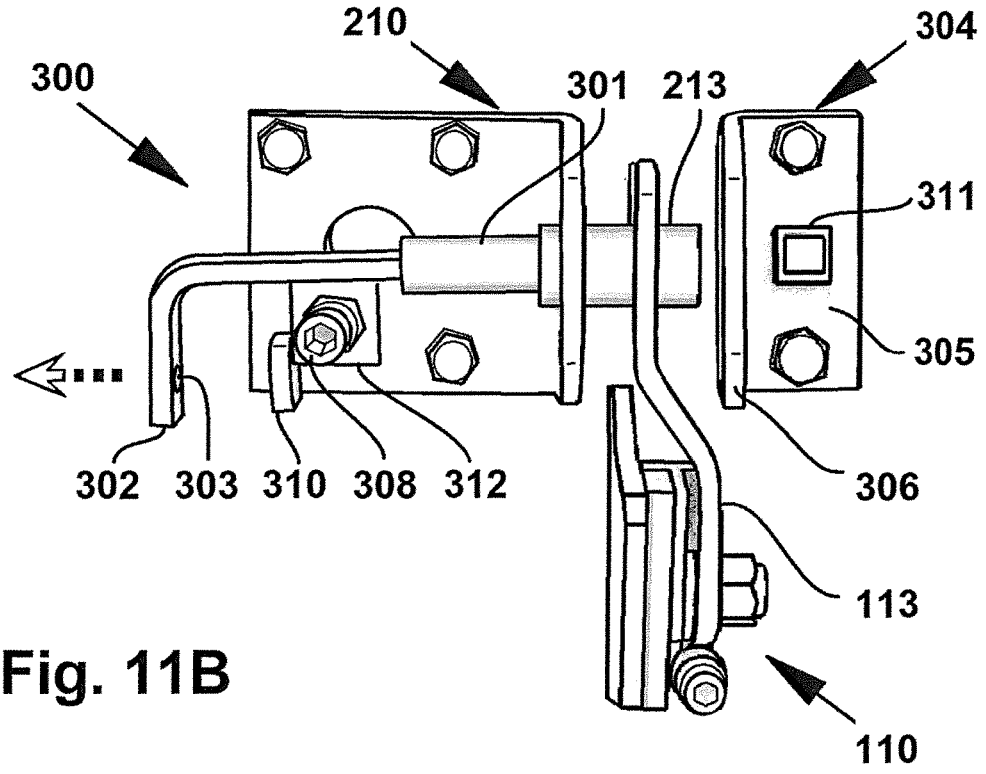
Fig. 11B

Fig. 20A
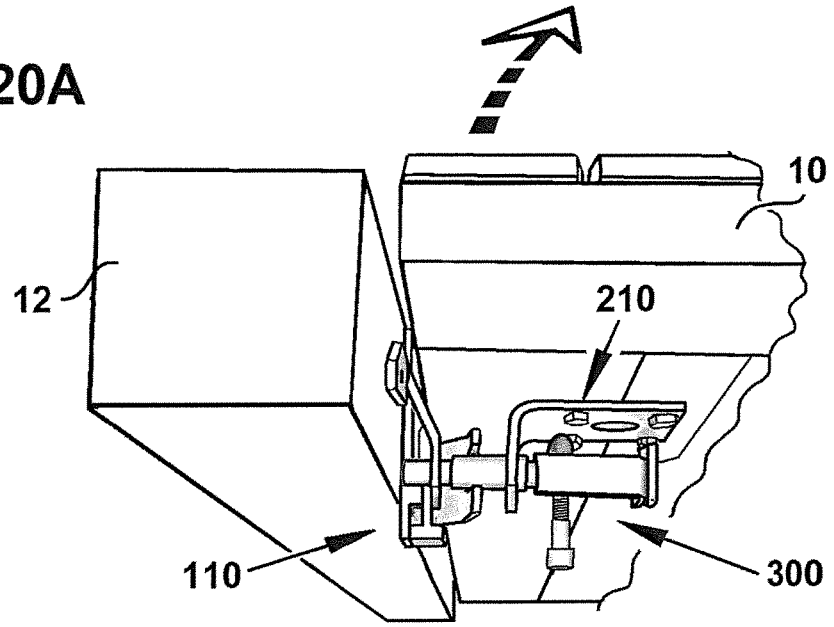
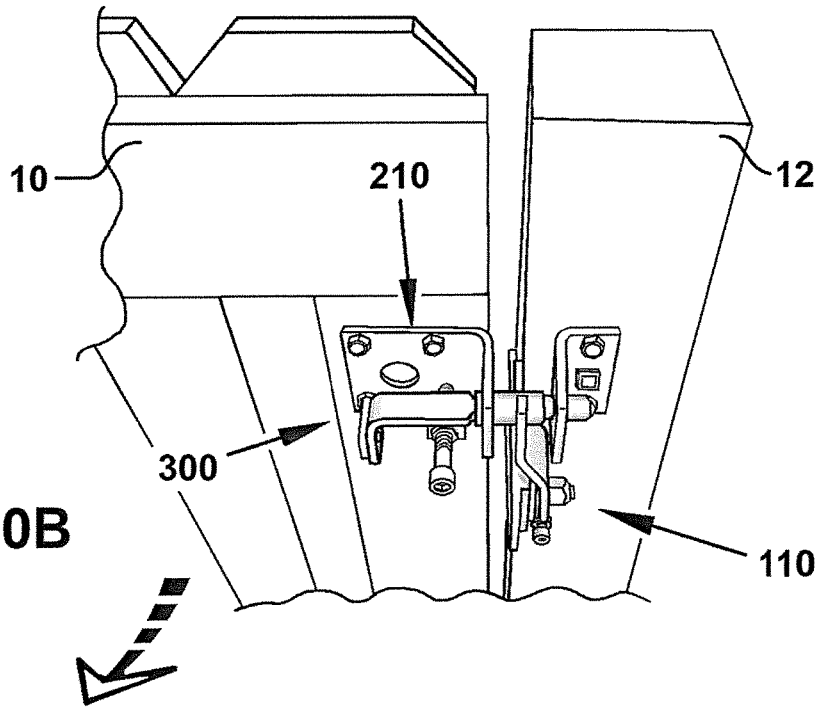
Fig. 20B

Fig. 23A
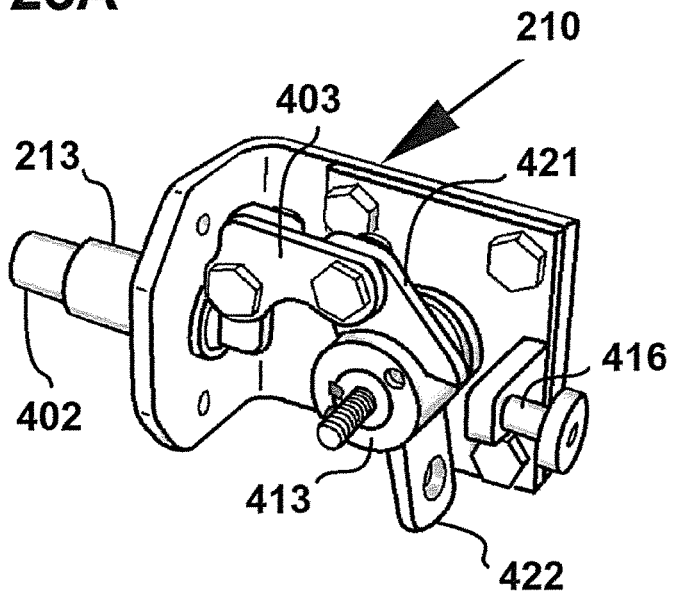
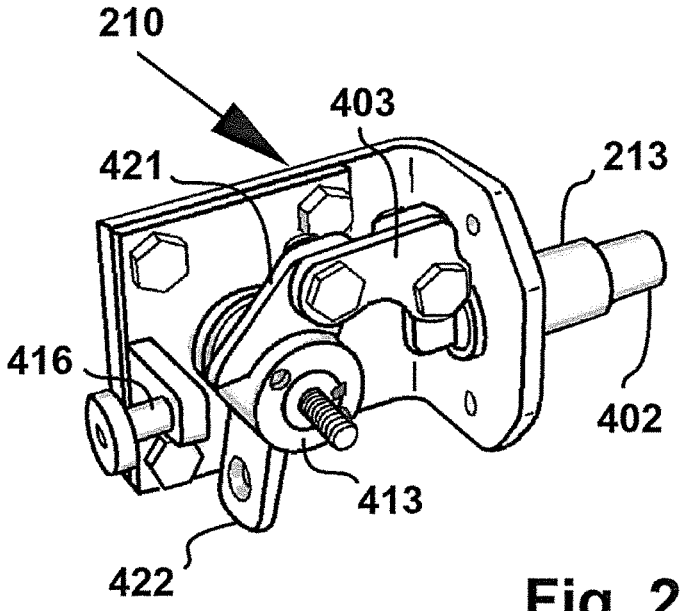
Fig. 23B

Fig. 24A
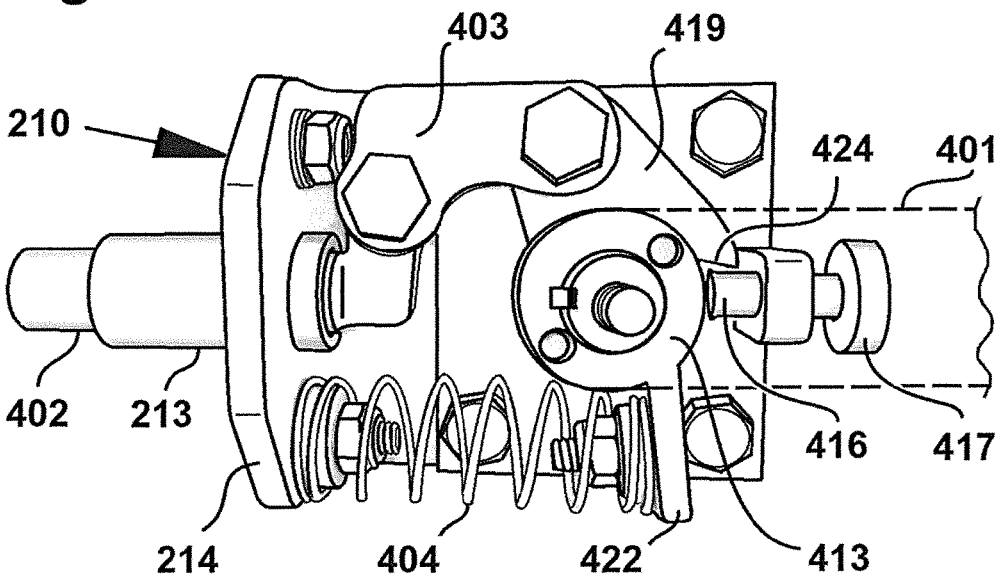
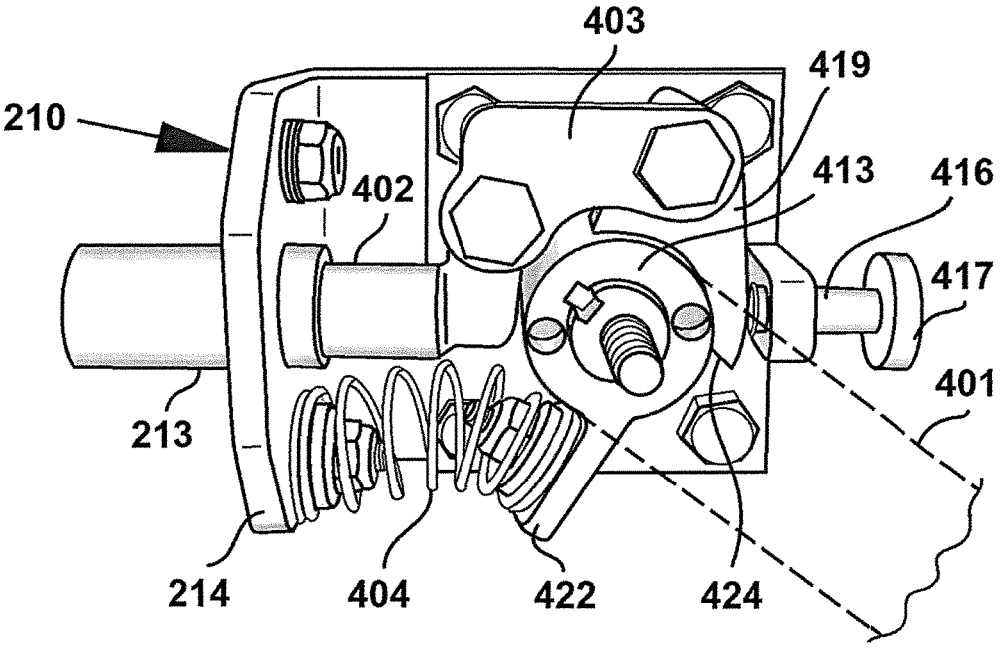
Fig. 24B

Fig. 27A
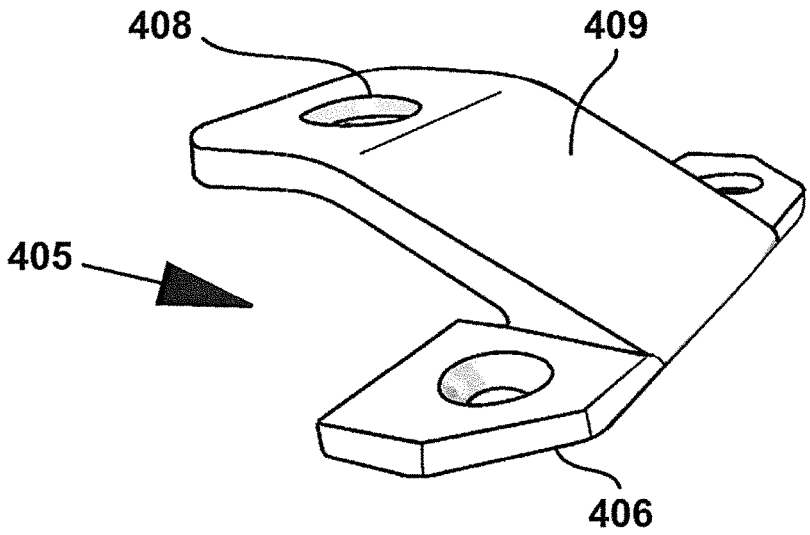
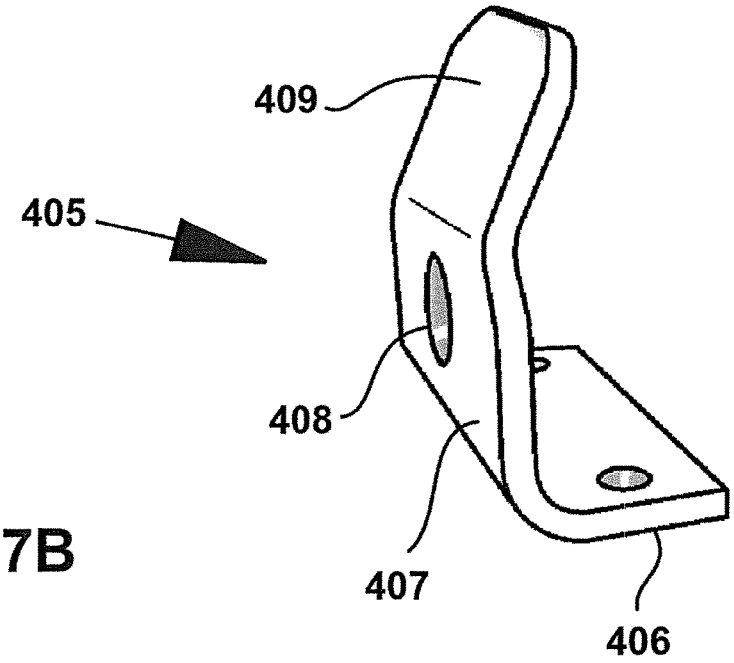
Fig. 27B

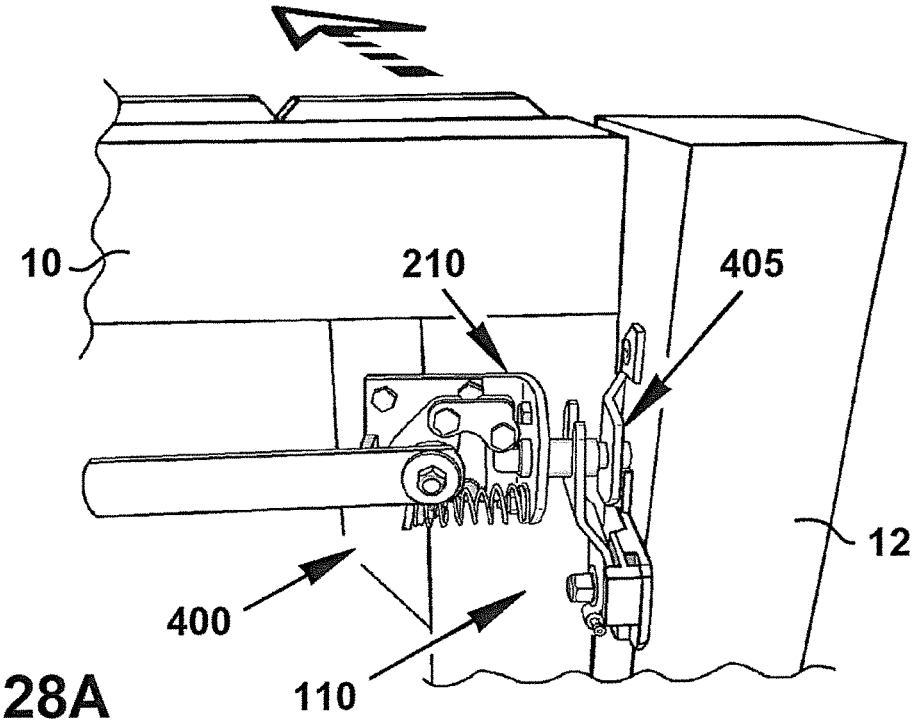
Fig. 28A
Fig. 28B
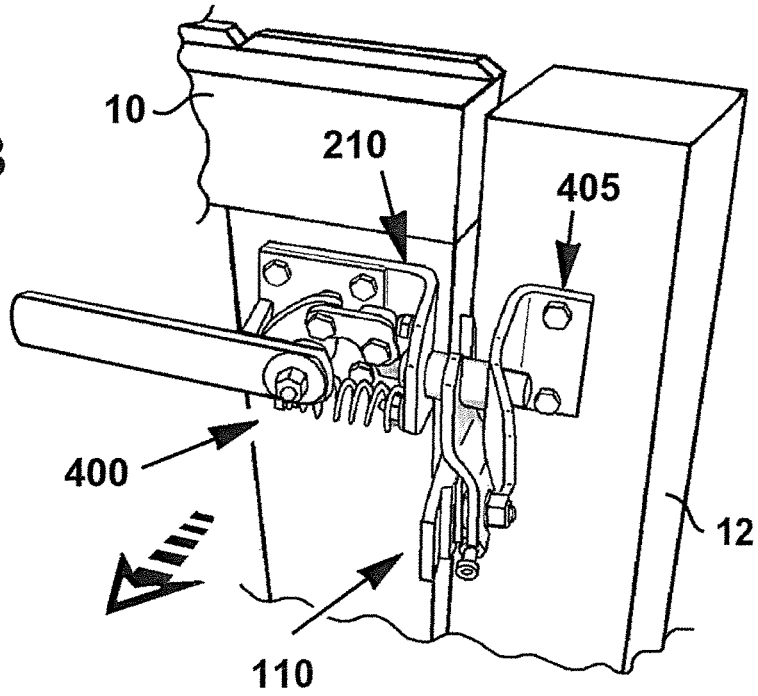

Fig. 29A
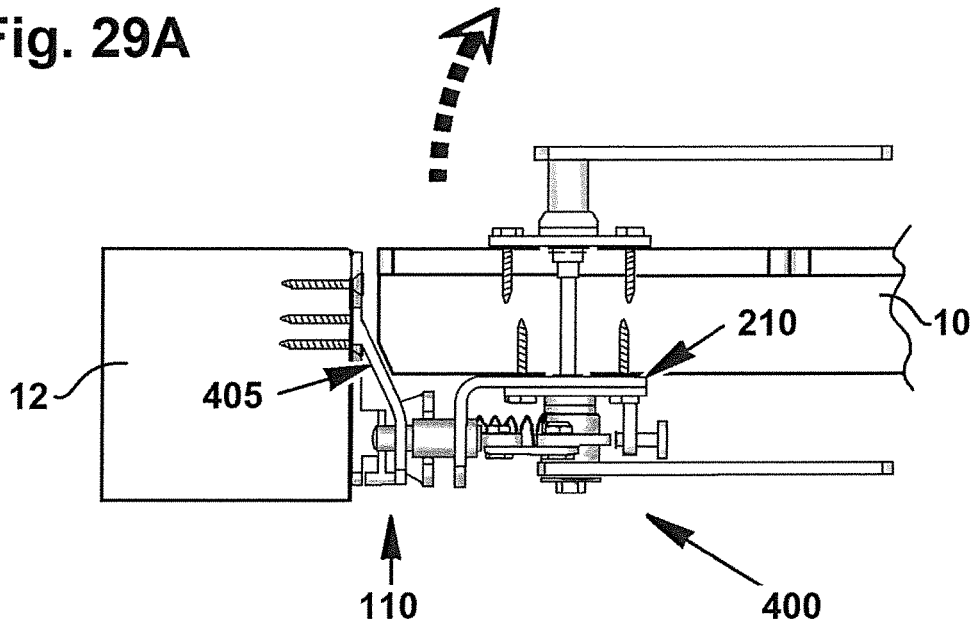
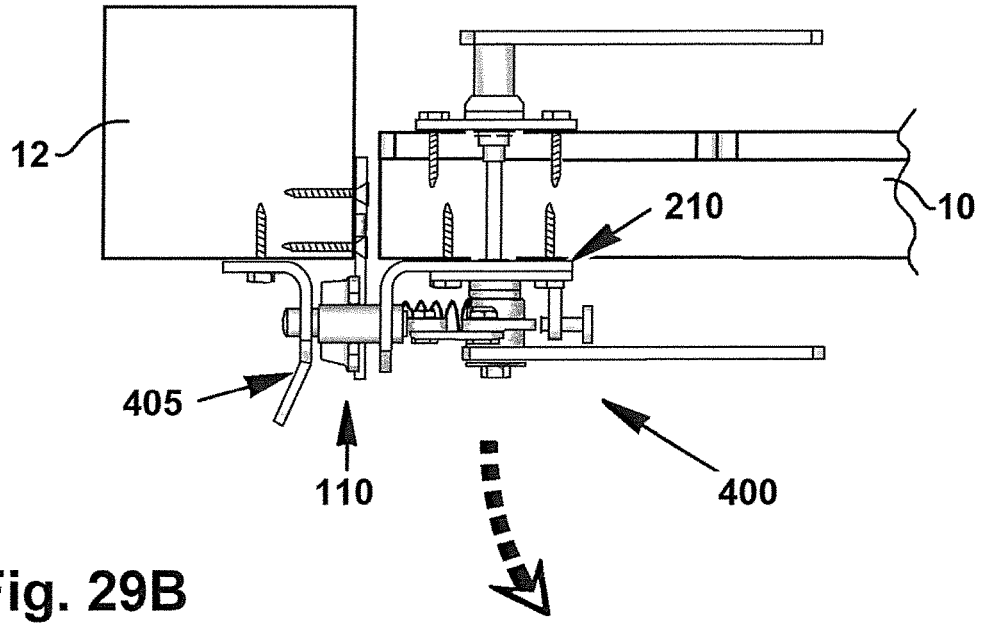
Fig. 29B

GATE LIFTER LATCH

BACKGROUND OF THE INVENTION

This application relates generally to the field of closure latches for side-hinged, swinging closures such as doors, panels, or gates, to be referred to herein collectively as gates. More particularly, the application relates to latches that address the problem of gate sag, whereby over time the weight of the gate results in the non-attached end of the gate opposite to the hinged side dropping or sagging.

Most gates are constructed by assembling individual members, such as for example wooden boards, into a substantially rectilinear configuration with both ends of the gate being in parallel. One end of the gate, the hinged end, is mounted to a hinge post or other structural supporting member with hinges. The other end of the gate is a free end which is not supported when the gate is in an open position. When closed, the free end of the gate is supported by a latch comprising two main components. A stationary component of the latch, often referred to as a catch or keeper, is mounted to a latch post or other structural support member. A swinging component of the latch, often referred to as a striker, is mounted to the free end of the gate, the striker being received and retained by the catch when the gate is closed.

When first installed, the catch and striker components of the latch are properly aligned in horizontal relationship to retain the gate in the closed position until the striker component of the latch is released to open the gate. It is very common over extended time periods for the free end of the gate to drop or sag, especially with gates made from wood or with excessively elongated gates, such as those used to allow vehicle access. When this occurs, closing and latching the gate requires manually lifting the free end to align the striker with the catch.

Gate latches typically comprise a striker component having a laterally extending pin, post or rod that is received within the slot of a catch component. To address the common problem of gate sag, an inclined lower ramp surface is usually provided on the catch, the inclined ramp surface extending from the bottom of the slot. With this structure, when the striker pin is no longer properly aligned with the slot of the catch assembly due to a small amount of gate sag, the person closing the gate must push or pull the gate to force the striker pin to ride up the ramp of the catch and enter the slot. This operation can be difficult for heavy or elongated gates, and if the free end of the gate has sagged excessively such that the striker pin does not align with the ramp, the person closing the gate will have to lift the free end of the gate a significant distance to bring the striker pin to the level of the ramp and slot on the catch. This can be very difficult for heavy gates.

In addition to providing the catch ramp, various other methods are used to address the gate sag problem. One solution is to reinforce the gate itself, such as by attaching a diagonal strut made of wire or cable from a point on the gate near the uppermost hinge to a point on the gate near the lower corner of the free end. Additional struts may be mounted in various directions to prevent the free end of the gate from sagging. Such attachments are unsightly and are often ineffective in precluding gate sag. A similar solution, especially for elongated gates, is to provide an extended vertical tower on, adjacent, or as part of the stationary hinge post. A wire or cable strut is then extended from the top of the extended tower to the upper corner of the free end of the gate. This solution is also unsightly, especially with short gates, and is typically only effective on elongated gates.

It is an object of this invention to provide a gate latch that addresses the problem of gate sag, the gate latch being a gate lifter latch wherein the structure of the latch is such that closure of the gate results in the lifting of the free end of the gate to the correct pre-sag height relative to the latch post, the closing and lifting operation occurring easily and with little effort on the part of the person closing the gate. It is a further object to provide such a gate lifter latch which comprises a lifting assembly having a pivoting lift arm, the lift arm being angularly adjustable to account for the increases in gate sag over time, such that when the gate is closed the striker pin is initially received in a receiving slot of the lift arm, with further closure of the gate pivoting the lift arm into a vertical orientation to raise the free end of the gate to the proper height. It is a further object to provide such a gate lifter latch in a basic embodiment, an embodiment operational with a manual locking assembly, or an embodiment operational with an automatic locking assembly. It is a further object to provide such a gate lifter latch that is capable of universal application, wherein the elemental parts or components of the latch may be rearranged for use with either inswing or outswing gates. These objects and objects not expressly set forth will become apparent upon review of the disclosure which follows.

SUMMARY OF THE INVENTION

The invention in various embodiments comprises in general a gate lifter or riser latch, the latch correcting gate sag such that upon closure the gate is lifted or raised to its proper, non-sagged position relative to the fence or other stationary structural members to which it is incorporated. In a basic embodiment, the gate lifter latch comprises a striker assembly and a catch lifting assembly, the striker assembly structured and adapted for mounting onto the free end of a gate and the catch lifting assembly structured and adapted for mounting onto a latching post, jamb, wall or similar fixed structural member, to be referred to herein collectively as a latching post, such that with the gate closed the striker and catch lifting assemblies cooperate to retain the gate in the closed position at the proper height, the striker assembly being releasable from the catch lifting assembly to open the gate.

The striker assembly in the basic embodiment comprises a generally horizontally oriented striker pin positioned on the free end of the gate. The catch lifting assembly comprises a pivoting lift arm oriented so as to pivot in a plane perpendicular to the plane occupied by the gate in the closed position. The pivoting lift arm is provided with an open-ended, striker pin receiving slot on its free end which receives and retains the striker pin when the gate is closed, the lift arm being vertically oriented when the gate is fully closed such that the free end of the gate is maintained at the proper height.

When the gate is opened, movement of the striker pin pivots the lift arm downward in the gate opening direction, the striker pin and gate end dropping into the sagged position. As the gate is fully opened, the striker pin completely disengages from the receiving slot of the lift arm. The catch lifting assembly is provided with a stop assembly which maintains the lift arm in the inclined position at which the striker pin was released from the lift arm slot. When the open and sagging gate is closed, the striker pin advances into and engages the open slot of the inclined lift arm. Further closure of the gate results in radial lifting of the striker pin and upward pivoting of the lift arm into the vertical orientation, thereby raising the free end of the gate to the proper, pre-sag alignment relative to the latching post. The stop assembly is adjustable so that as the amount of sag in free end of the gate increases over time, the lowermost position of the lift arm can be adjusted downward into the proper receiving angle. Likewise, when the gate lifter latch is mounted to correct a gate that is already sagging, the proper lower position of the lift arm can be pre-set.

In alternative embodiments, the gate-mounted striker assembly may further comprise a manual or automatic locking assembly providing for a secure latching system, providing a means to lock the gate in the closed position, or providing a means for operational handles to be utilized on both the front and back of the gate. In a locking assembly embodiment, the striker pin is a hollow member and a bolt catch member having an apertured bolt catch is mounted on the latch post beyond the lifting arm assembly, the aperture in the bolt catch member being aligned to receive a laterally reciprocating bolt passing through the hollow striker pin when the gate is in the closed position. The bolt is mounted to the striker assembly such that it is reciprocated manually to latch/lock and unlatch/unlock the gate. Alternatively, a spring mechanism may be provided such that the bolt automatically extends into the bolt catch member when the gate is closed.

The components of the lifting assembly of the gate lifter latch are preferably designed and structured such that they may be rearranged as necessary to be applicable to left opening or right opening inswing gate or outswing gates, and further such that the main components may always be mounted onto the interior side of the gate such that a concealed, clean appearance is presented on the outside of the gate.

Alternatively summarized, the invention in various embodiments is a gate lifter latch comprising a catch lifting assembly and a striker assembly; said striker assembly comprising a striker pin; said catch lifting assembly comprising a pivoting lift arm member; whereby with said striker assembly mounted to a gate and said catch lifting assembly mounted to a latch post, said striker pin is received and lifted by said lift arm member during closure of the gate. Furthermore, such a gate lifter latch wherein said catch lifting assembly further comprises a lifter base plate, and said lift arm member is pivotally mounted to said lifter base plate; wherein said lift arm member comprises an open slot sized to receive said striker pin therein; wherein said catch lifting assembly further comprises a lift arm inclination adjusting assembly, said lift arm inclination adjusting assembly determining the lowermost position of said lift arm member; wherein said catch lifting assembly further comprises a lift arm inclination adjusting assembly, said lift arm inclination adjusting assembly determining the pivot range of said lift arm member; wherein said lift arm member pivots between a vertical position and a horizontal position; wherein said lift arm and said lifter base plate are structured such that said lift arm may be mounted to either side of said lifter base plate; further comprising a manual gate latch assembly comprising a latch bolt and bolt catch member; further comprising an automatic gate latch assembly comprising a latch bolt and bolt catch member; and/or wherein said gate lifter latch is structured such that said gate lifter latch may be disassembled and reassembled for use on a right inswing gate, a left inswing gate, a right outswing gate or a left outswing gate.

Alternatively still, the invention in various embodiments is a gate lifter latch comprising a catch lifting assembly and a striker assembly; said striker assembly comprising a striker pin mounted to a striker base plate, said striker base plate adapted to be mounted to a gate on its free end; said catch lifting assembly comprising a pivoting lift arm member comprising an open slot, said lift arm member pivotally mounted to a lifter base plate, said catch lifting assembly adapted to be mounted to a latch post; whereby with said striker assembly mounted to the gate and said catch lifting assembly mounted to the latch post, upon closure of the gate said striker pin is received within said open slot of said lift arm member and said lift arm member pivots into a substantially vertical position and lifts said striker pin. Furthermore, the invention wherein said catch lifting assembly further comprises a lift arm inclination adjusting assembly, said lift arm inclination adjusting assembly determining the lowermost position of said lift aim member; wherein said catch lifting assembly further comprises a lift arm inclination adjusting assembly, said lift arm inclination adjusting assembly determining the pivot range of said lift aim member; wherein said lift arm and said lifter base member are structured such that said lift arm may be mounted to either side of said lifter base member; further comprising a manual gate latch assembly comprising a latch bolt and bolt catch member; further comprising an automatic gate latch assembly comprising a latch bolt and bolt catch member; wherein said gate lifter latch is structured such that said gate lifter latch may be disassembled and reassembled for use on a right inswing gate, a left inswing gate, a right outswing gate or a left outswing gate.

Alternatively still, the invention in various embodiments is a gate lifter latch comprising a catch lifting assembly and a striker assembly; said striker assembly comprising a striker pin mounted to a striker base plate, said striker base plate adapted to be mounted to the free end of a gate; said catch lifting assembly comprising a pivoting lift arm member comprising an open slot, said lift arm member pivotally mounted to a lifter base plate, said catch lifting assembly adapted to be mounted to a latch post; said catch lifting assembly further comprising a lift arm inclination adjusting assembly, said lift arm inclination adjusting assembly determining the lowermost position of said lift arm member; whereby with said striker assembly mounted to the gate and said catch lifting assembly mounted to the latch post, upon closure of the gate said striker pin is received within said open slot of said lift arm member and said lift arm member pivots into a substantially vertical position and lifts said striker pin. Furthermore, the invention further comprising a manual gate latch assembly comprising a latch bolt and bolt catch member; and/or further comprising an automatic gate latch assembly comprising a latch bolt and bolt catch member.

BRIEF DESCRIPTION OF THE DRAWINGS

FIGS. 9A through 9D illustrate alternative positioning and reconfiguration of the stop member on the catch lifter assembly of FIG. 3 to accommodate left and right outswing or left and right inswing gates.

FIGS. 10A through 10D illustrate alternative positioning and reconfiguration of the gate lifter latch of FIG. 3 to accommodate left and right outswing or left and right inswing gates.

FIGS. 11A and 11B illustrate an embodiment of the gate lifter latch which includes a manual gate latch assembly.

FIGS. 20A and 20B illustrate the alternative positioning and reconfiguration of the gate lifter latch which includes a manual gate latch assembly for either inswing or outswing gates.

FIGS. 23A and 23B illustrate a partially assembled automatic gate latch assembly showing alternative embodiments for a left opening or right opening gate.

FIGS. 24A and 24B illustrate a partially assembled automatic gate latch assembly in the locked and unlocked position.

FIGS. 27A and 27B illustrate a bolt catch member having ramp surface for an inswing or an outswing gate.

FIGS. 28A and 28B illustrate a single handle embodiment of the gate lifter latch automatic gate latch assembly as mounted on an outswing and an inswing gate.

FIGS. 29A and 29B is a top view illustrating a double handle embodiment of the gate lifter latch automatic gate latch assembly as mounted on an outswing and an inswing gate.

DETAILED DESCRIPTION OF THE INVENTION

With reference to the drawings, which are intended to be descriptive and illustrative but not limiting as to the scope and embodiments of the invention, the invention is described as follows in detail. While the description makes use of the terms "gate", "fence", "latch post" and hinge post", it is to be understood that the term "gate" is to collectively reference a pivotally mounted gate, door or any similar closure panel member, the term "fence" is to collectively reference any vertically oriented fence, wall, or similar member having an opening in which the gate is mounted, and the terms "latch post" and "hinge post" are to collectively register any vertical supports, jambs, posts or the similar members to which the latch and the hinges are respectively affixed.

In general, the invention in various embodiments is a releasable gate lifter latch configured to retain a gate 10 in the closed position and to allow opening of the gate 10 when desired. The gate lifter latch accounts for and corrects gate sag when the gate 10 is closed, whereby the free end 11 of the gate 10 is lifted into the proper non-sagging position relative to the latch post 12.

Figure 1:
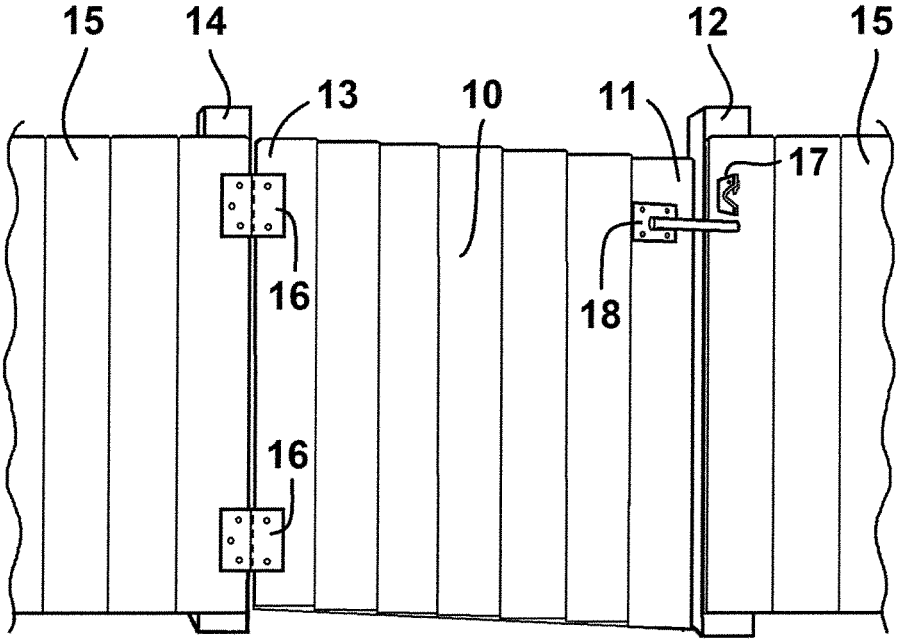
Fig. 1 Prior Art
FIG. 1 is an illustration of a prior art gate wherein the striker pin mounted to the free end of the gate does not properly align with a standard latch in the closed position due to excessive sagging of the free end of the gate.
Figure 2:
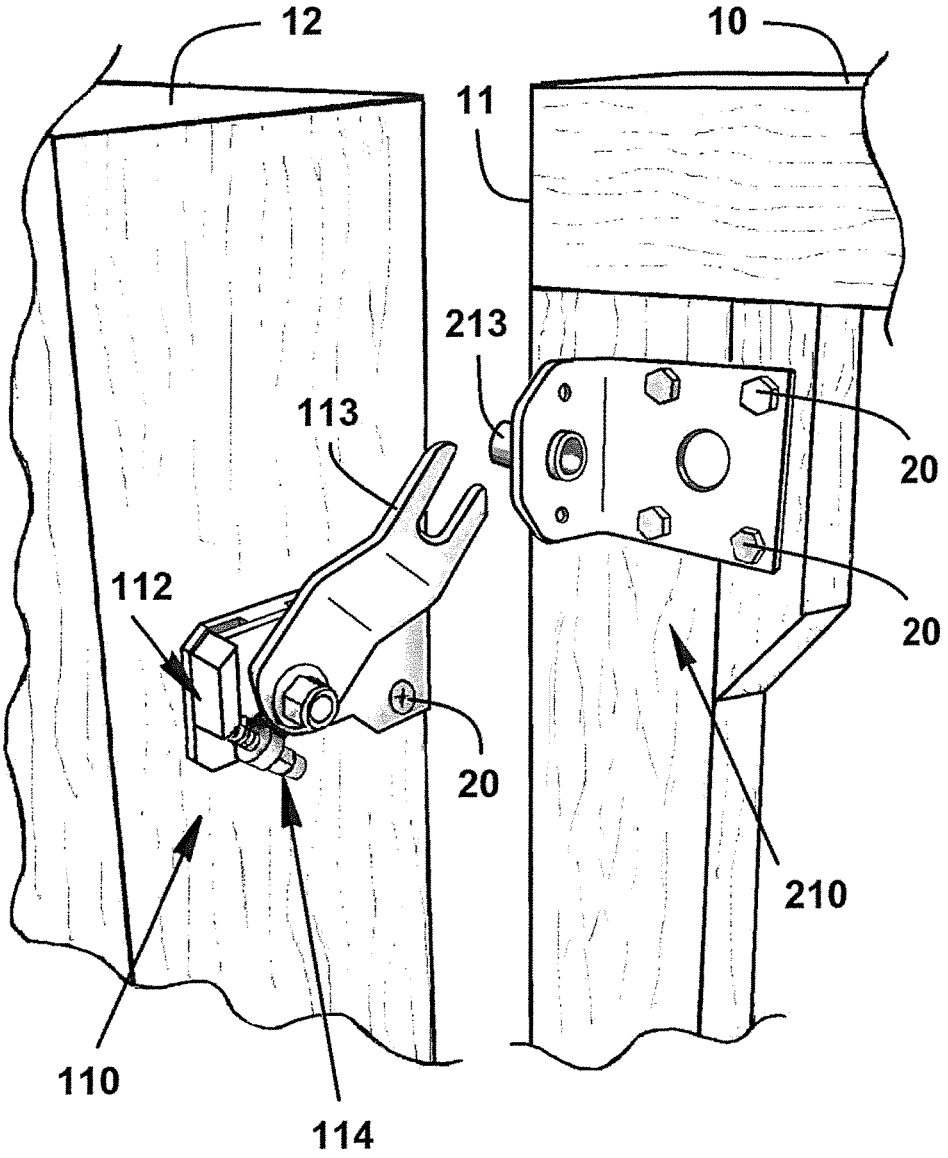
FIG. 2 is a view of an embodiment of the striker assembly and the catch lifting assembly of the gate lifter latch, shown with the gate partially open.

FIG. 1 is an illustration of a sagging gate 10 and a representative prior art gate latch. The gate 10 is incorporated within a fence 15 and has a hinged end 13 pivotably mounted to a hinge post 14 by hinges 16. Because the free end 11 of the gate 10 has sagged over time, the latch striker 18 does not properly align with the latch catch 17 when the gate 10 is closed, requiring the user to lift the free end 11 of the gate 10 in order to position the latch striker 18 in the latch catch 17. This problem of gate sag is addressed by the invention at hand as described below.

Embodiments of the gate lifter latch is shown in FIGS. 2 through 10. The gate lifter latch comprises a striker assembly 210 which is mounted onto the free end 11 of the gate 10 by mechanical fasteners 20, such for example as screws or bolts. The striker assembly 210 comprises a striker base plate 211 having mounting apertures 212 to receive the mechanical fasteners 20, a pin flange 214 that extends generally perpendicularly outward from the base plate 211, and a striker post or pin 213 which extends generally perpendicularly outward from the pin flange 214 so as to be generally horizontally disposed and exposed in the direction of the free end 11 of the gate 10, the central axis of the striker pin 213 being parallel to the plane of the opening in the fence 15. The striker pin 213 may be solid or hollow.

The gate lifter latch further comprises a catch lifting assembly 110 which is mounted to the stationary latch post 12, the catch lifting assembly 110 comprising a lifter base plate 111 having mounting apertures 131 which receive mechanical fasteners 20, a pivoting lift arm or receiving member 113, a stop member 112 and a lift aim inclination adjusting assembly 114. The lift arm 113 is pivotally connected to lifter base plate 111 in a manner that allows it to freely pivot between a vertical orientation and an inclined orientation. The lift arm 113 comprises a pivot end base segment 128 and a free end receiving segment 129 preferably connected by a transition segment 123 such that the pivot end base segment 128 and the free end receiving segment 129 occupy different yet substantially parallel planes.

The free end receiving segment 129 comprises an open slot 121 defining a pair of prongs or tines 122, such that the lift arm 113 is a forked member, the transverse dimension of the slot 121 being larger than the diameter of the striker pin 213, such that the striker pin 213 may be received within the slot 121.

Figure 3:
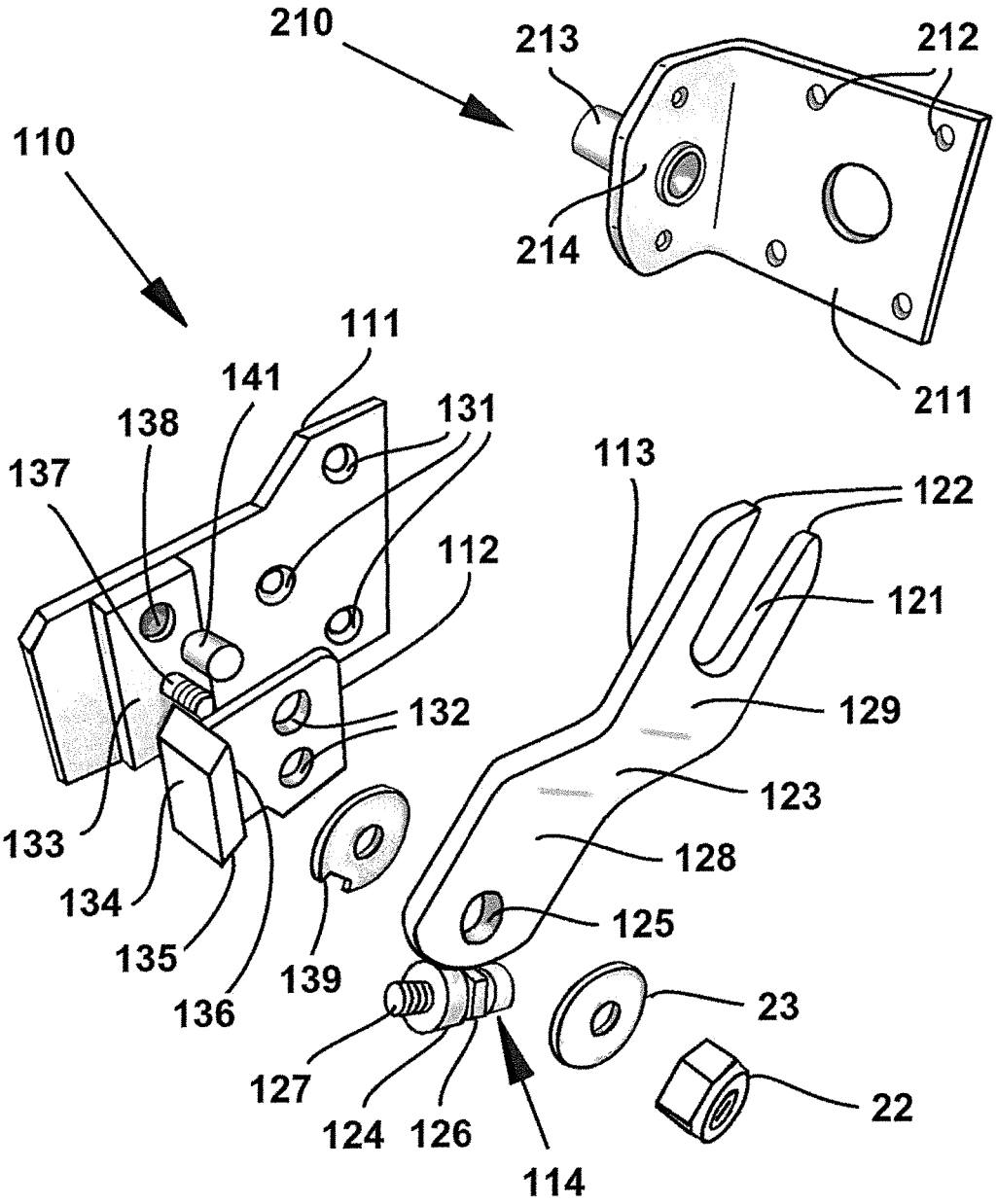
FIG. 3 is an exploded view of the striker assembly and the catch lifting assembly of FIG. 2.

As shown best in FIG. 3, the lift arm 113 is provided with a pivot bore 125 located in the pivot end base segment 128. A threaded post 137 for mounting the lift arm 113 extends perpendicularly from the lifter base plate 111 through the pivot bore 125 and the lift arm 113 is secured to threaded post 137 with a washer 23 and locking nut 22. A lift arm inclination adjusting assembly 114 is provided which comprises a stop member 112 that is positioned between the lift arm 113 and the lifter base plate 111, and is preferably mounted to a stop platform 133 located on the lifter base plate 111, the stop member 112 preferably having a pair of mounting bores 132, one of which receives the threaded post 137 and the other which receives a removable stop mounting pin 141 which is positioned in a stop pin recess 138 on the stop platform 133. The stop member 112 further comprises a stop body 134 which is located so as to prevent movement beyond vertical of the lift arm 113 when the gate 10 is closed. The stop body 134 comprises an arm stop surface 136 facing the edge of the lift arm 113 and an angled adjuster stop surface 135 at the lower end.

To accommodate increased sag over time, as well as to set the initial receiving position for installation to correct a sagging gate 10, the inclination adjusting assembly 114 is provided to enable adjustment of lift arm 113 so as to define and limit the pivot range of the lift arm 113 between a substantially vertical position and a substantially horizontal position. The inclination adjusting assembly 114 determines the lowermost position of the lift arm 113 such that the lift arm slot 121 is properly positioned to receive the striker pin 213 of the striker assembly 210 when a sagging gate 10 is closed. With the gate 10 in the closed position, the lift arm 113 is vertically oriented in a vertical position, similar to a "12 o'clock" position. The lower limit of the radial movement of the lift arm 113 will be set as required to match the location of the striker pin 213 on the sagging gate 10 anywhere from a few degrees out of vertical for a gate 10 with only a small amount of sag to almost 90 degrees or the "9 o'clock" position for gates 10 with greater amounts of sag.

Figure 6:
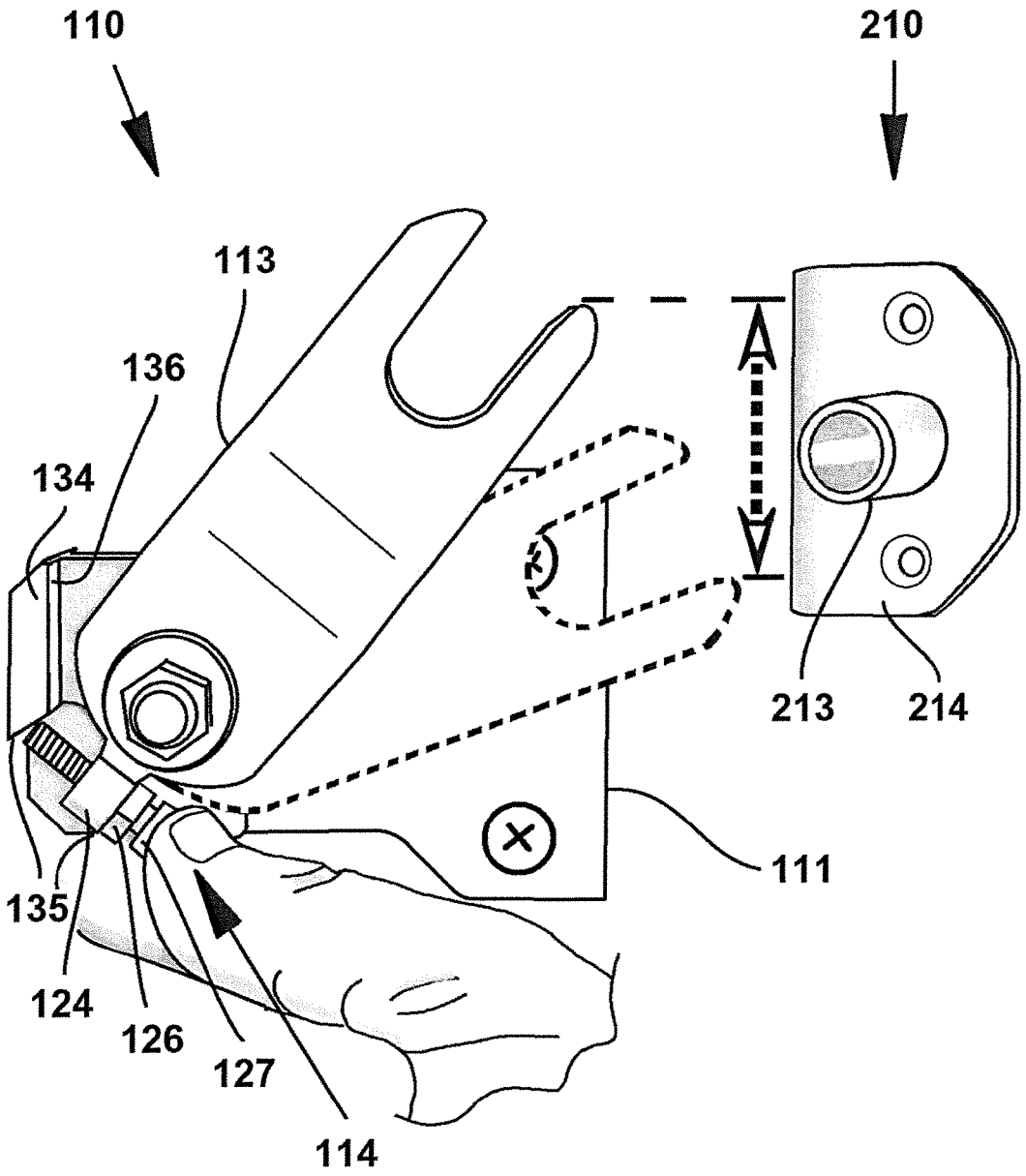
FIG. 6 illustrates the range of adjustability for the lowermost inclination of the lift arm of the catch lifting assembly of FIG. 3 to accommodate various amounts of gate sag.
Figure 7:
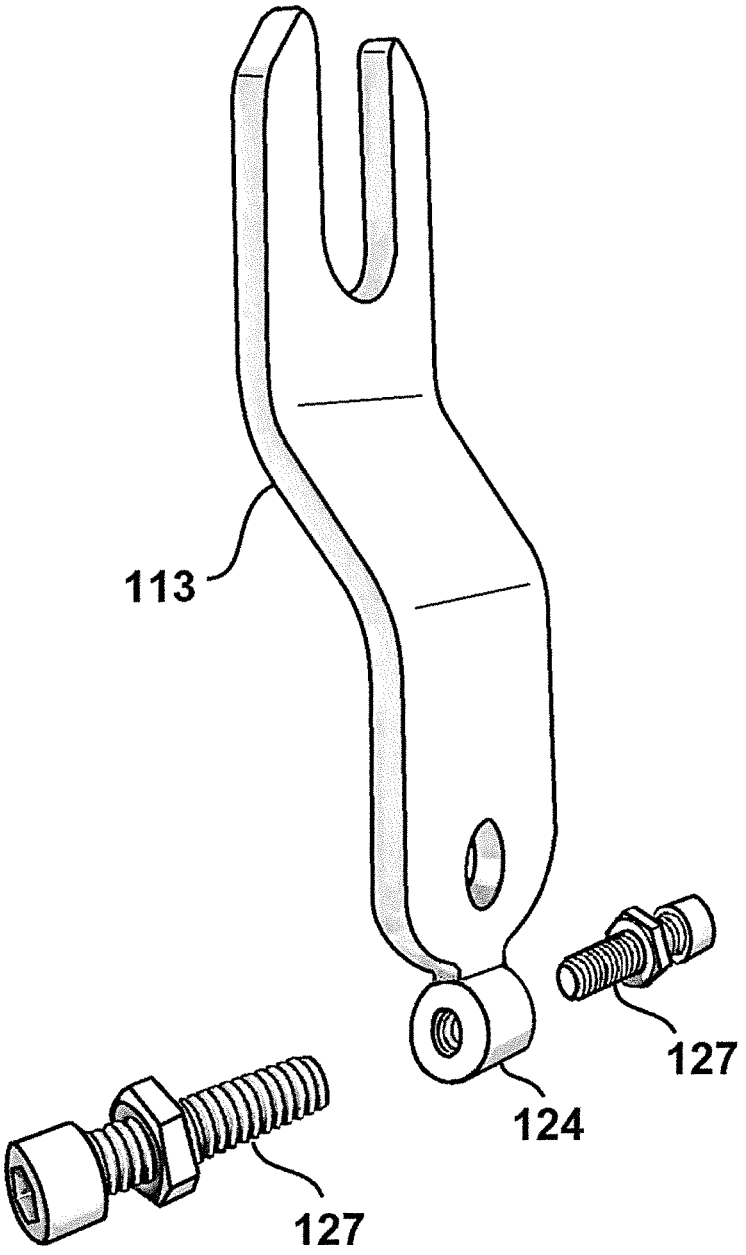
FIG. 7 illustrates the ability of the threaded collar of the lift arm member of FIG. 3 to receive the adjustment screw from either side depending on the orientation of the lift arm member.

In the embodiment shown, the lift arm inclination adjusting assembly 114 further comprises an internally threaded collar 124 that is affixed to the pivot end base segment 128 of the lift arm 113, such as by welding or other suitable method. The threaded collar 124 is positioned below the pivot axis of the lift arm 113 and may receive a lift arm adjustment screw 127 through either side, thus permitting reversability of the lift arm 113 on the catch lifting assembly 110, the central axis of the bore in the threaded collar 124 and the lift arm adjustment bolt 127 being oriented within the pivot plane of the lift arm 113. A lock nut 126 is disposed on the lift arm adjustment screw 127 to preclude unwanted movement of the lift arm adjustment screw 127 relative to the threaded collar 124. A notched or keyed washer 139 is positioned on the threaded post 137 between the lift aim 113 and the stop member 112, the key accommodating the body of the threaded collar 124. In this manner, the end of the lift arm adjustment bolt 127 abuts the angled adjustor stop surface 135 on the stop body 134 to limit downward pivoting of the lift arm 113, as shown in FIG. 6. The lowermost position of the lift arm 113 is controlled by adjusting the inclination adjusting assembly 114 in order to provide the proper pivot range for the lift arm 113 and to prevent the lift arm 113 from passing below the proper position to receive the striker pin 213 when the gate is being closed. To shorten the pivot range of the lift arm 113, the lift arm adjustment bolt 127 is advanced through the threaded collar 124 toward the angled adjustor stop surface 135. To increase the pivot range of the lift arm, i.e. to allow the free end receiving segment 129 to pivot farther out of vertical and more toward horizontal, the lift arm adjustment bolt 127 is retracted through the threaded collar 124 away from the angled adjustor stop surface 135. For example, whereas a pivot range of ten degrees from vertical may be sufficient to account for minor gate sag, a pivot range of forty-five degrees or more may be required to account for major gate sag, as shown in FIG. 6.

Figure 4:
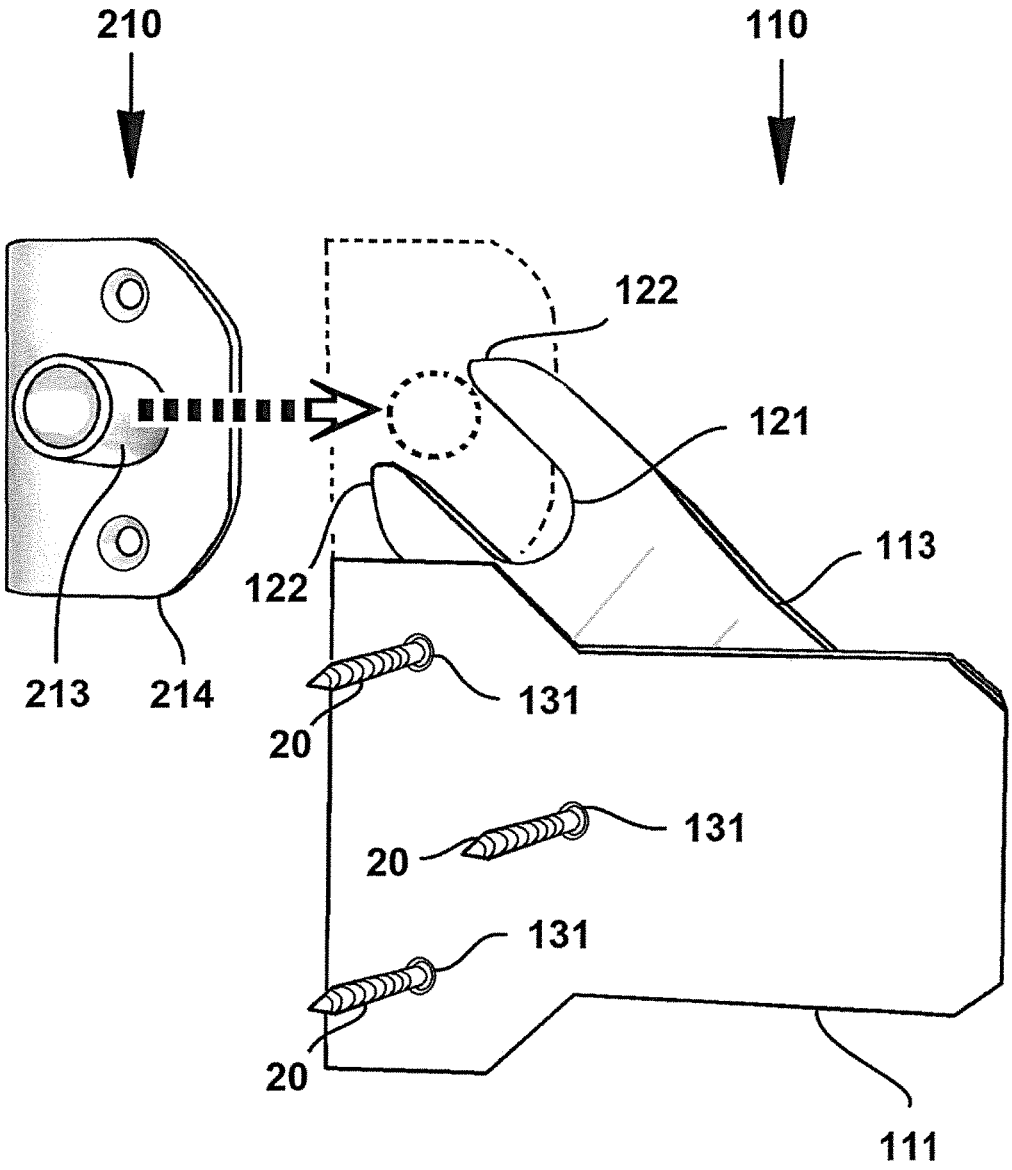
FIG. 4 illustrates horizontal movement of the striker pin into the slot of the lifting arm of the catch lifting assembly of FIG. 3 as the gate is partially closed.
Figure 5:
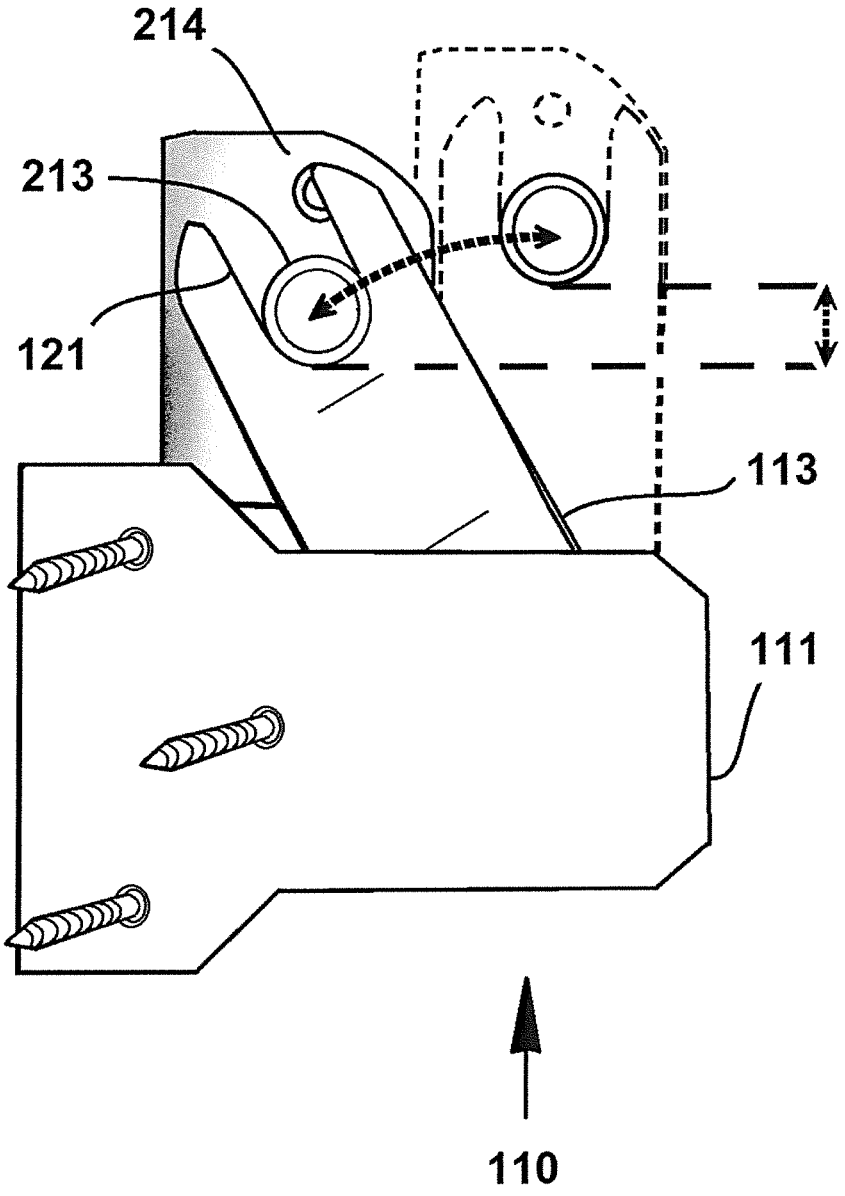
FIG. 5 illustrates upward movement of the striker pin due to pivoting movement of the lifting aim of the catch lifting assembly of FIG. 3 as the gate is fully closed.

FIGS. 4 and 5 illustrate the lifting action of the gate lifter latch. As the gate 10 is closed, striker pin 213 is advanced into the open end of slot 121 in the free end receiving segment 129 of lift arm 113, the lowermost position of the lift arm 113 having been set to the proper angle to receive the striker pin 213 as is it moves horizontally toward the catch lifting assembly 110. As the gate 10 is advanced from the sagged open position to the fully closed position, the striker pin 213 contacts and engages the upper prong 122, causing the lift arm 113 to pivot toward the vertical orientation. This pivoting movement causes the striker pin 213 to seat in the base of slot 121, such that the lift arm 113 raises the striker pin 213 and the free end 11 of the gate 10 as pivoting continues to the lift arm 113 vertical orientation. In this manner, the lift arm 113 functions as a cam and the striker pin 213 functions as a cam follower, such that the energy required to raise the free end 11 of the gate 10 is significantly reduced. The catch lifting assembly 110 having been appropriately mounted to the latch post 12 and the striker assembly 210 having been appropriately mounted to the gate free end 11 for proper alignment of the gate 10 when closed, the striker pin 213 and gate free end 11 are thus raised to the proper position relative to the fence 15 that they would have occupied prior to gate sag having occurred.

Opening the gate 10 results in a reverse sequence of events. As the gate 10 is opened, the lift arm 113 pivots out of vertical orientation into the lowermost pre-set position, the striker pin 213 exits the lift arm slot 121 and gate 10 returns to the fully sagged position. As the lift arm 113 pivots downward, the end of the lift arm adjustment bolt 127 comes into contact with the angled adjustor stop surface 135 such that further downward movement is precluded and the lift arm 113 is maintained at the proper position to receive the striker pin 213 when the gate is closed.

Figure 8A:
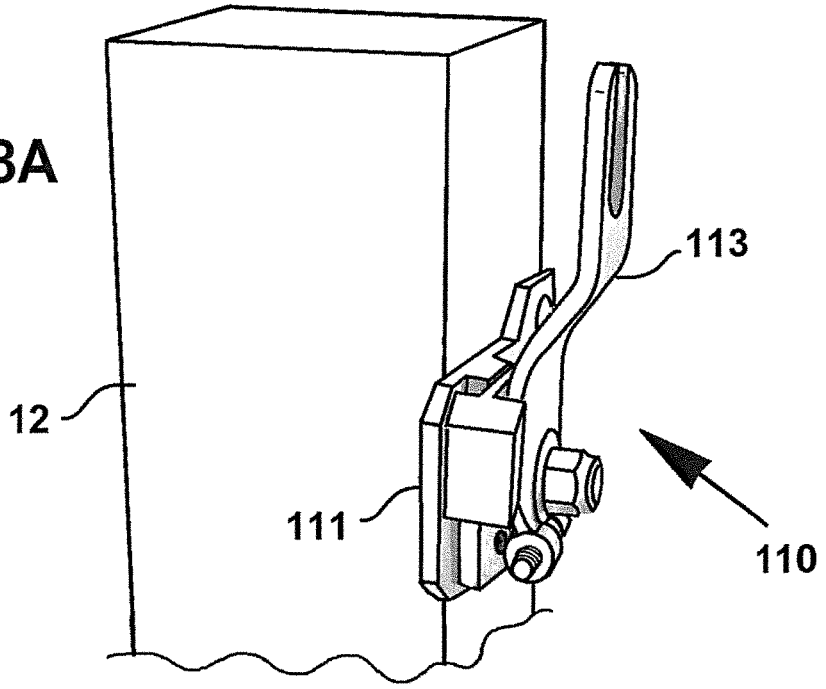
FIGS. 8A and 8B illustrate alternative positioning and reconfiguration of the catch lifting assembly of FIG. 3 on a latch post to accommodate either outswing or inswing gates.
Figure 8B:
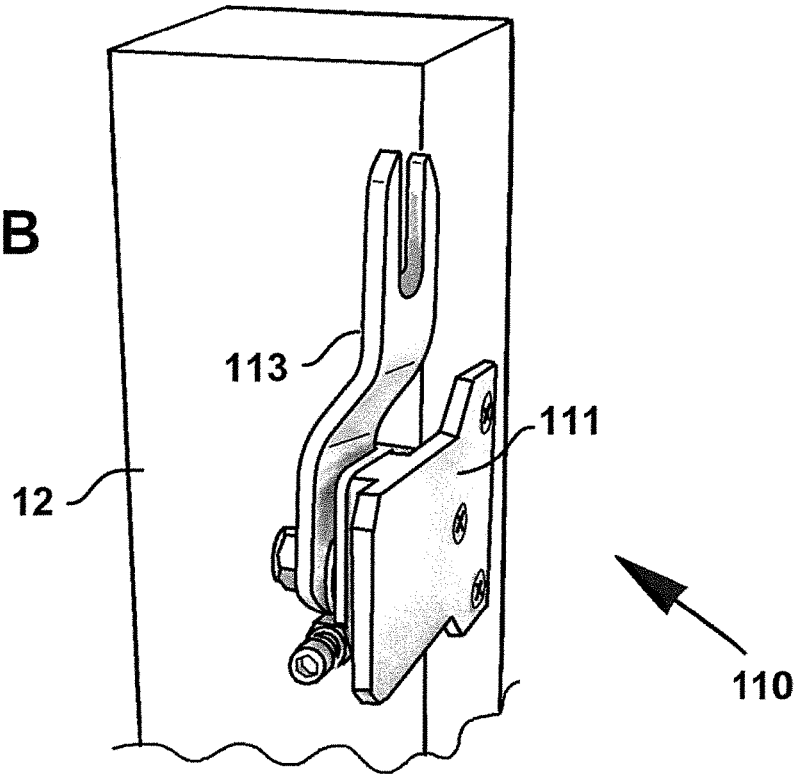

In a preferred embodiment the components of the gate lifter latch are designed and constructed such that manipulation or re-positioning of the gate lifter latch components by disassembling and reassembling is easily achieved to make the gate lifter latch universal, such that the gate lifter latch may be used in conjunction with right or left inswing gates 10 or right or left outswing gates 10, as illustrated in FIGS. 8 through 10. For an outswing gate 10, the catch lifting assembly 110 may be mounted to the latch post 12 as shown in FIG. 8A, the catch lift assembly 110 being oriented with the lift arm 113, stop member 112 and lift aim inclination adjusting assembly 114 located on the side of the lifter base plate 111 facing away from the latch post 12. For an inswing gate, as shown in FIG. 8B, the catch lift assembly 110 is reversed on the latch post 12 and oriented with the lift arm 113, stop member 112 and lift arm inclination adjusting assembly 114 being located on the side of the lifter base plate 111 facing toward the latch post 12. Although the orientation of the lift arm 113 remains the same relative to the gate free end 11 for both an outswing and an inswing gate 10, for the outswing gate 10 the catch lift assembly 110 is assembled with the lift arm 113 transitioning away from the lifter base plate 111, while for the inswing gate 10 the lift arm 113 is reversed so as to transition toward the lifter base plate 111, such that with either orientation the lift arm slot 121 is properly positioned to receive the striker pin 213.

In addition to the lift aim 113, the orientation of the stop member 112 and the position of the stop mounting pin 141 is altered depending on whether the gate 10 is outswing or inswing, and whether the gate 10 opens left or opens right, as shown in FIG. 9A for a right outswing gate 10, in FIG. 9B for a left outswing gate 10, in FIG. 9C for a right inswing gate 10 and in FIG. 9D for a left inswing gate 10. FIGS. 10A through 10D provide top views of the gate lifter latch as mounted on a right outswing gate 10 (FIG. 10A), a left outswing gate 10 (FIG. 10B), a right inswing gate 10 (FIG. 10C) and a left inswing gate 10 (FIG. 10D). In this manner the components of the embodiment shown in FIG. 3 may be rearranged for use in any of the four situations as depicted.

In a further embodiment, the gate lifter latch is readily adaptable for use in conjunction with a manual or automatic gate latch assembly. As used herein, the term "gate latch assembly" shall be taken to signify a structure that secures the gate 10 in the closed position such that a physical action by the user is required in order to release the gate 10 so that it may be opened. The physical action may include for example movement of a handle, sliding a bolt and/or removing a security lock.

Figure 12:
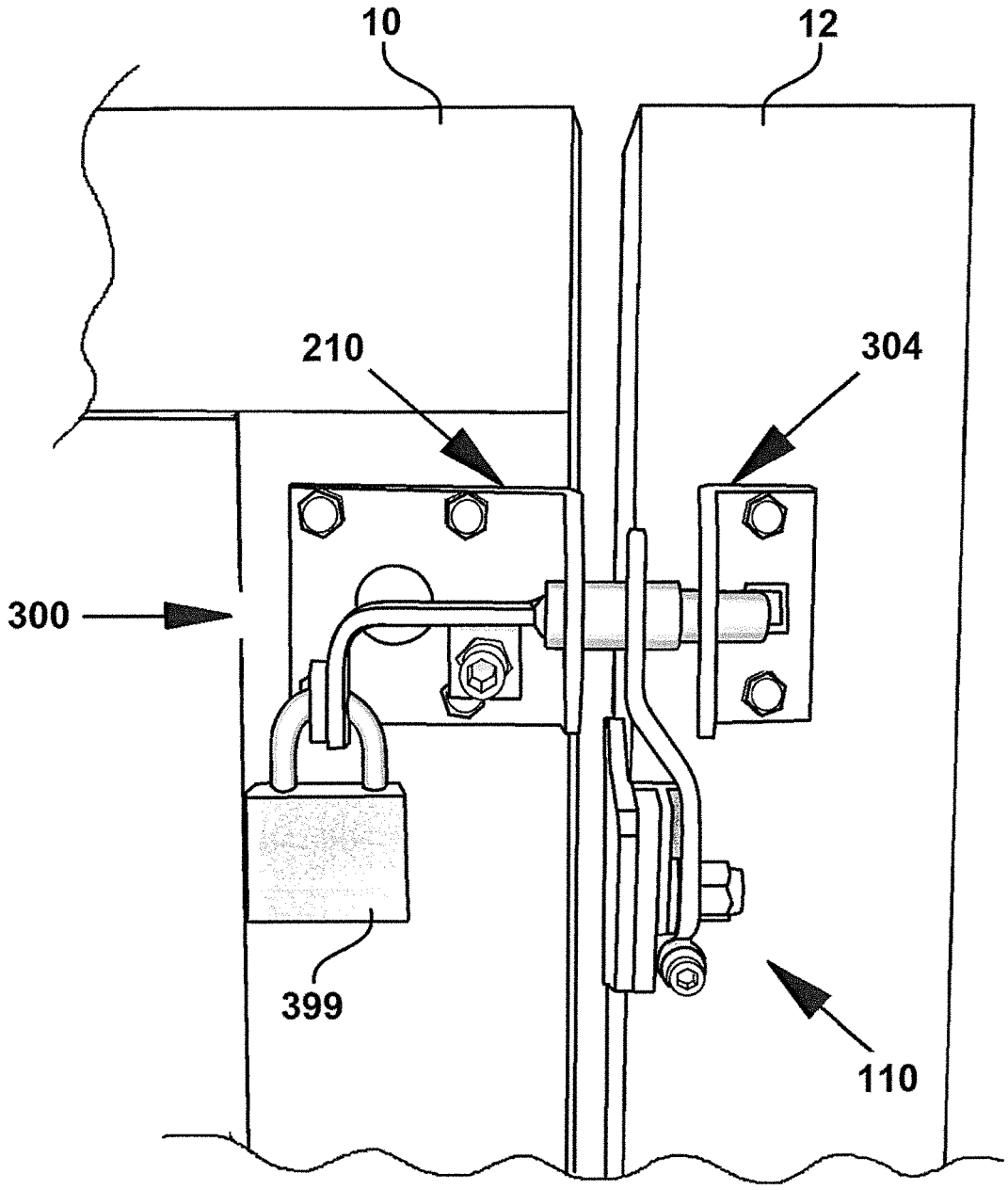
FIG. 12 illustrates the embodiment of FIGS. 11A and 11B with the manual gate latch assembly alternatively positioned to prevent accidental bolt sliding and permit padlock usage.
Figure 13:
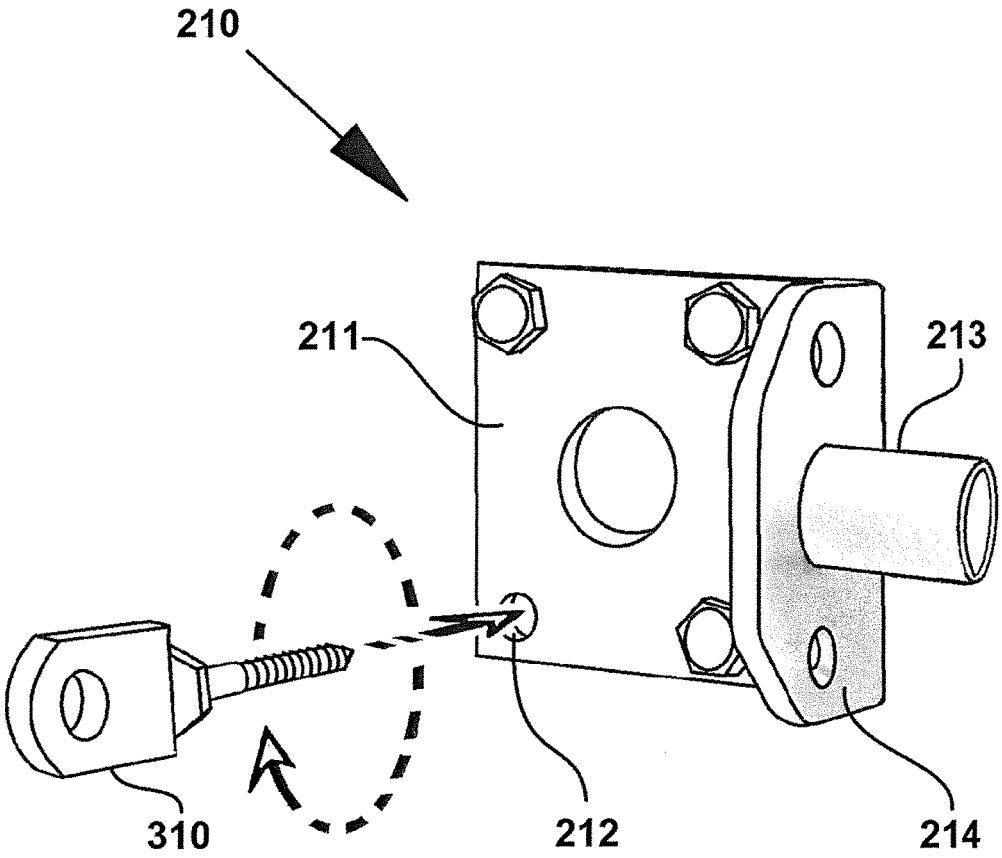
FIG. 13 illustrates the positioning of the manual gate latch assembly paddle bolt in the base plate of the striker assembly.
Figure 14:
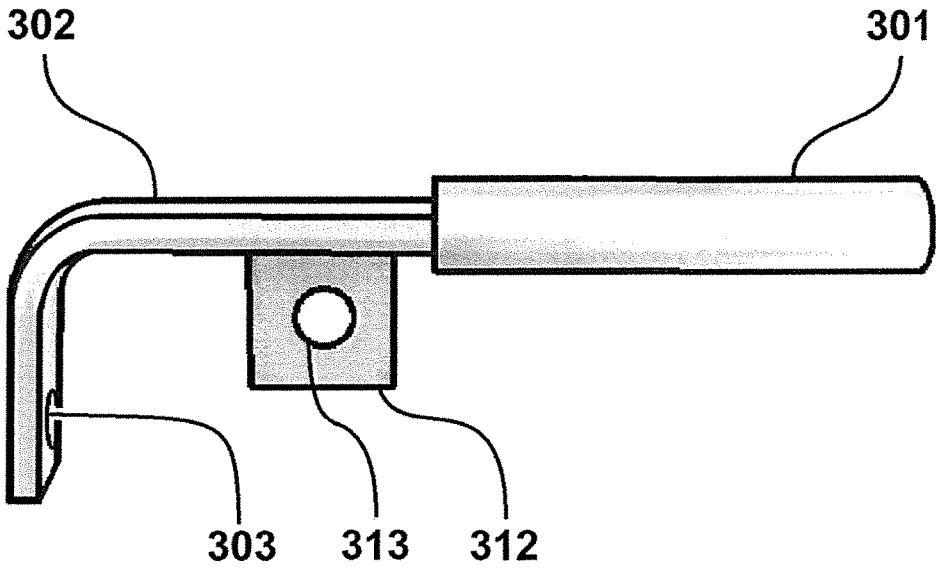
FIG. 14 illustrates an embodiment of the latch bolt for the manual gate latch assembly.
Figure 15:
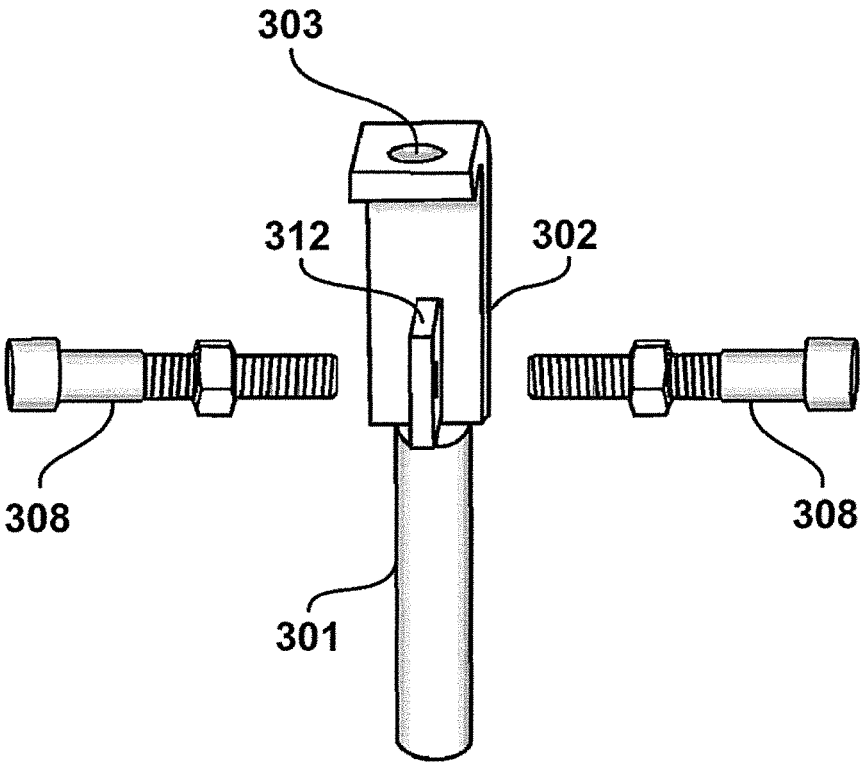
FIG. 15 illustrates the ability of the latch bolt of FIG. 14 to receive the handle screw from either side depending on the orientation of the latch bolt.
Figure 16:
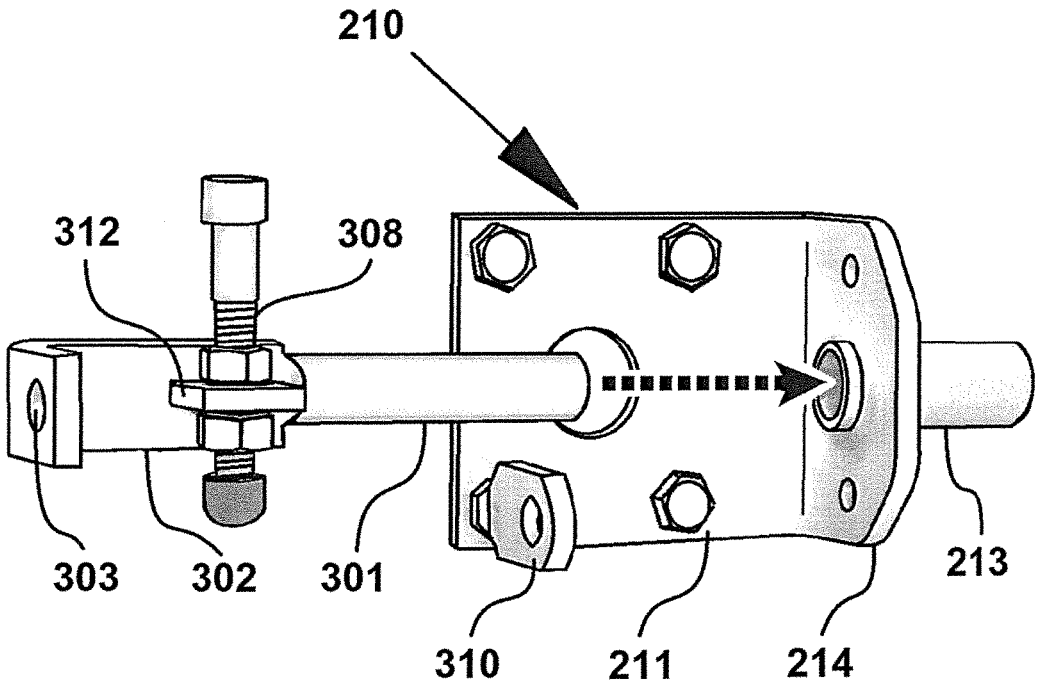
FIG. 16 illustrates the positioning of the latch bolt relative to the hollow striker pin.

In one embodiment, as shown in FIGS. 11 through 20, the securement assembly is a manual gate latch assembly 300 that requires a physical action to secure the gate 10 in the closed position (FIG. 11A) and a physical action to release the gate 10 so that it may be opened (FIG. 11B), the manual gate latch assembly 300 comprising mainly a sliding latch bolt 301 structured for reciprocal movement in the axial direction. For this embodiment, the striker pin 213 of the striker assembly 210 is hollow so as to receive the sliding latch bolt 301 therethrough. The latch bolt 301 is provided with an L-shaped handle 302 having a lock receiving bore 303, as shown in FIG. 13, which aligns with the aperture of a paddle bolt 310 inserted into one of the striker base mounting apertures 212. When the latch bolt 301 is advanced through the striker pin 213 and the L-shaped handle 302 is rotated downward, a removable security lock 399 passing through the lock receiving bore 303 and the paddle bolt 310 may be used to prevent retraction of the latch bolt 301 (FIG. 12). The latch bolt 301 may be rotated about its axis within the hollow striker pin 213 such that the L-shaped handle 302 may be positioned to either side of the paddle bolt 310.

A bolt catch member 304 having a base plate 305, a bolt flange 306 extending generally perpendicularly from the base plate 305 and a bolt receiving aperture 307, is affixed to the latch post 12 with mechanical fasteners 20 at the proper location for the bolt receiving aperture 307 to receive the latch bolt 301 when the striker pin 213 on the gate free end 11 is fully lifted into the proper closed height by the lift arm 113 and the latch bolt 301 is advanced through the striker pin 213. For an outswing gate 10, as shown in FIG. 20A, the bolt flange 306 of the bolt catch member 304 extends at a non-perpendicular angle from the base plate 305, and the base plate is configured so as to conform with the striker pin flange 214 of the striker assembly 210.

With the lock 399 removed, the gate 10 is opened by sliding the latch bolt 301 out of the bolt catch member 304 or by rotating the handle 302 of the latch bolt 301 clear of the paddle bolt 310 and pulling the latch bolt 301 through the hollow striker pin 213 to retract it from the bolt catch member 304. The operation is reversed to lock the gate 10.

Figure 17A:
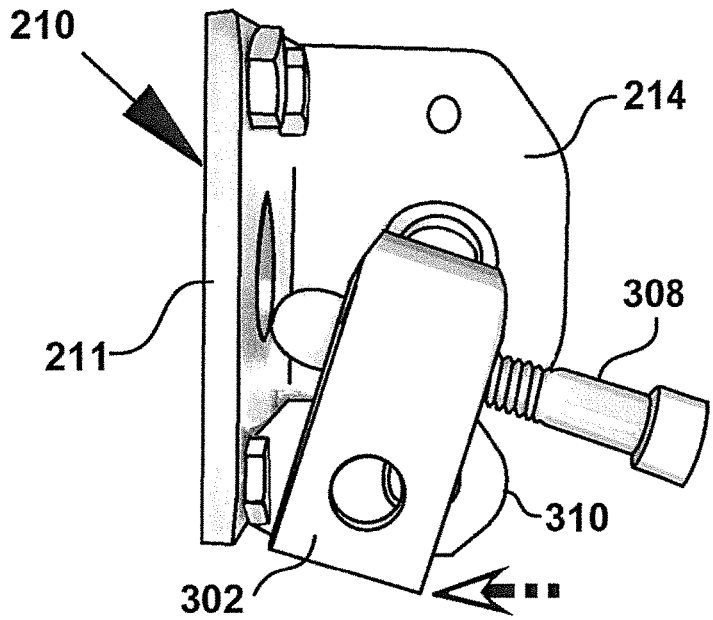
FIGS. 17A and 17B illustrate the variable alignment positioning of the L-shaped handle relative to the apertured paddle bolt.
Figure 17B:
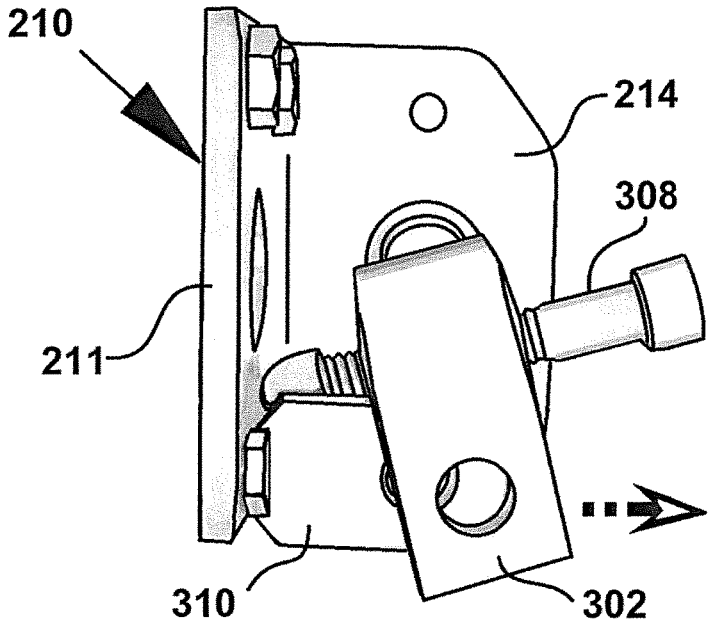
Figure 18A:
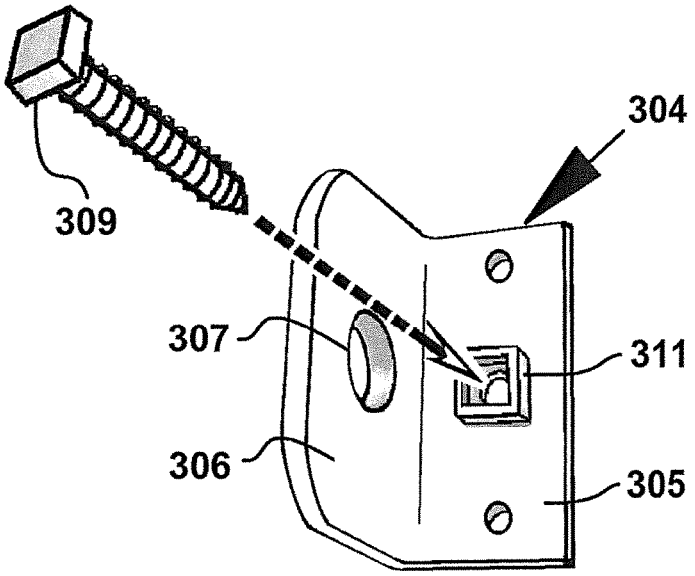
FIGS. 18A and 18B illustrate an embodiment of a bolt catch member having an anti-rotational receptacle and non-circular-headed mounting screw such that the bolt catch must be rotated in order to fully engage the mounting screw in the latch post.
Figure 18B:
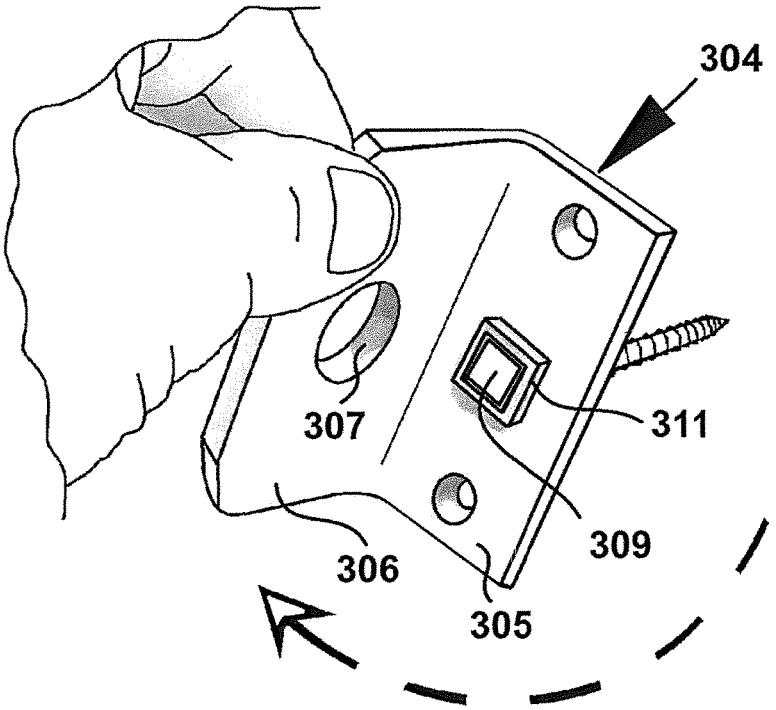
Figure 19:
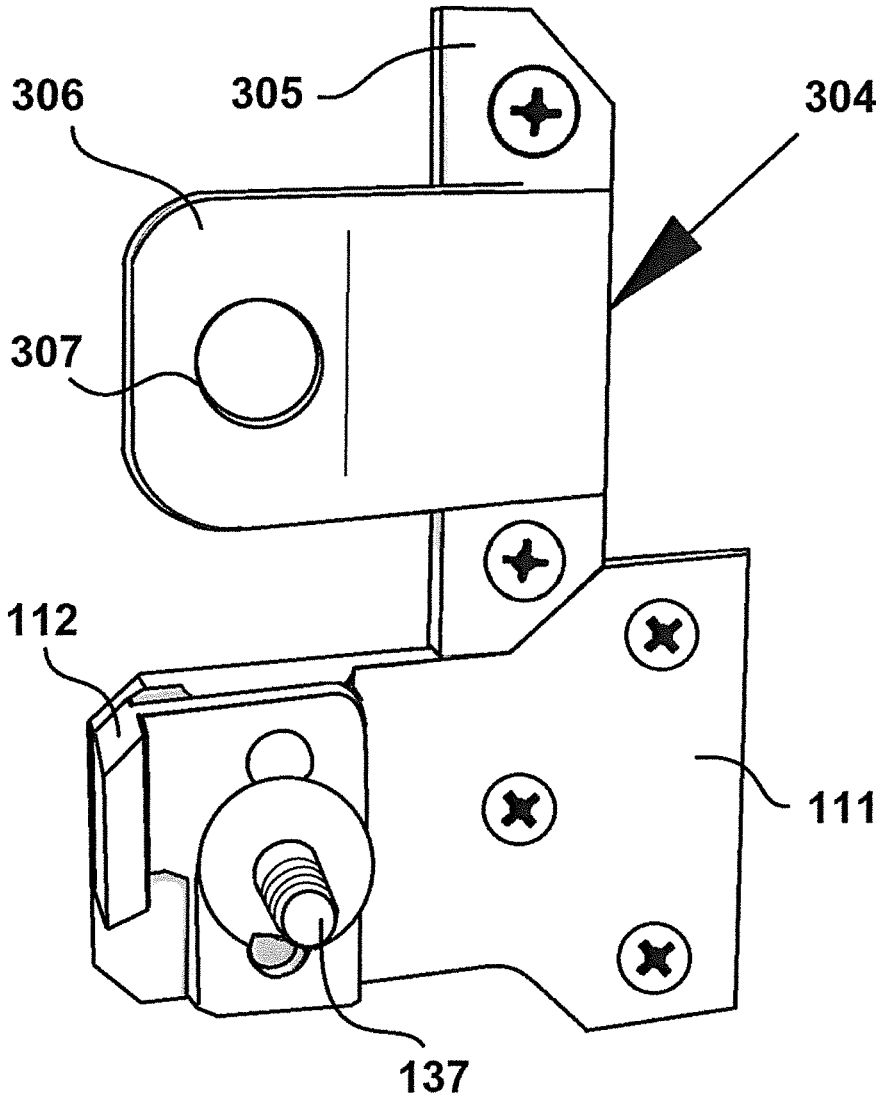
FIG. 19 illustrates an alternative embodiment of the bolt catch member which accommodates an outswing gate.
Figure 21:
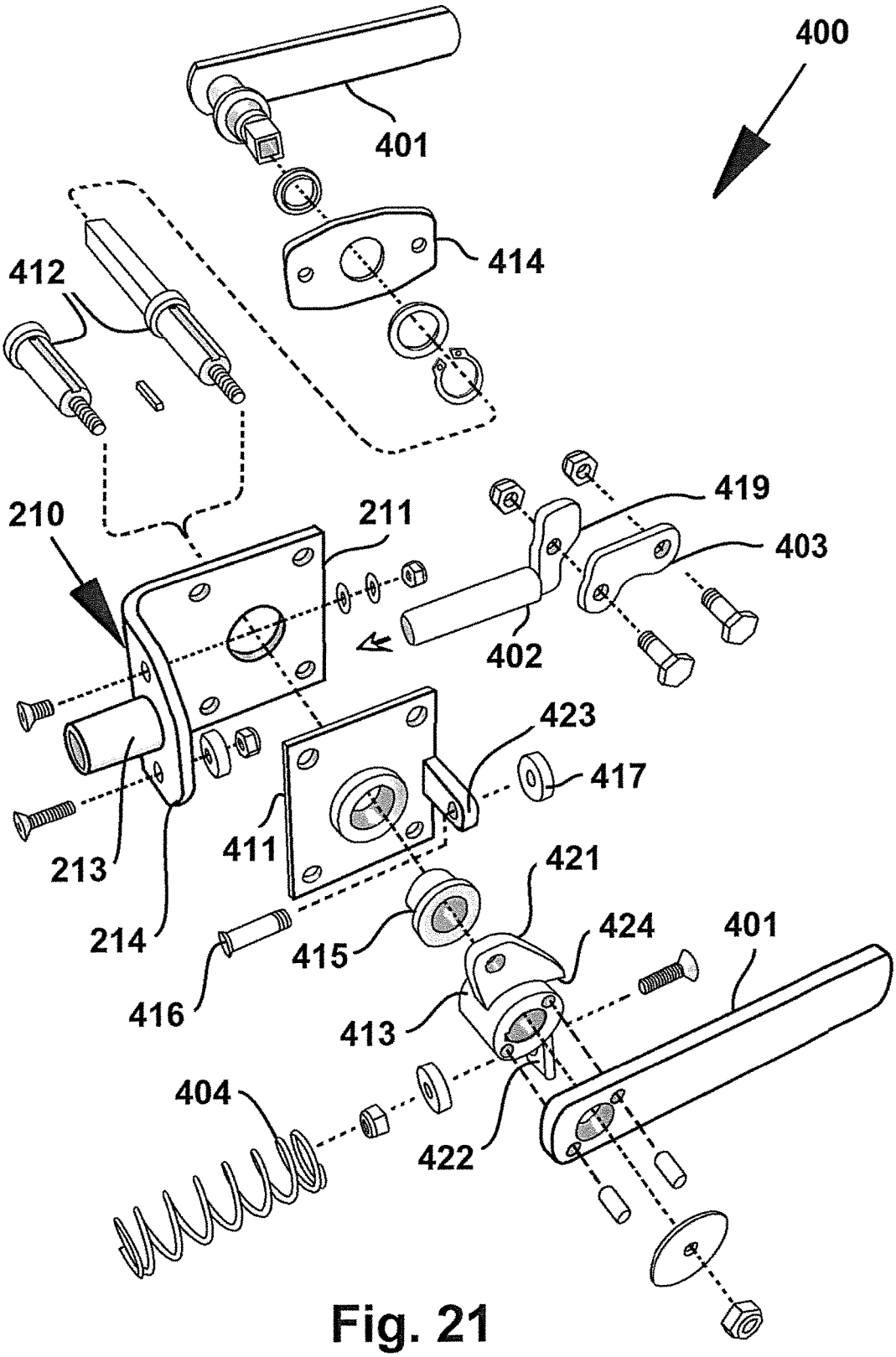
FIG. 21 is an exploded view showing an embodiment for a gate lifter latch automatic gate latch assembly having either a single or double handle.
Figure 22:
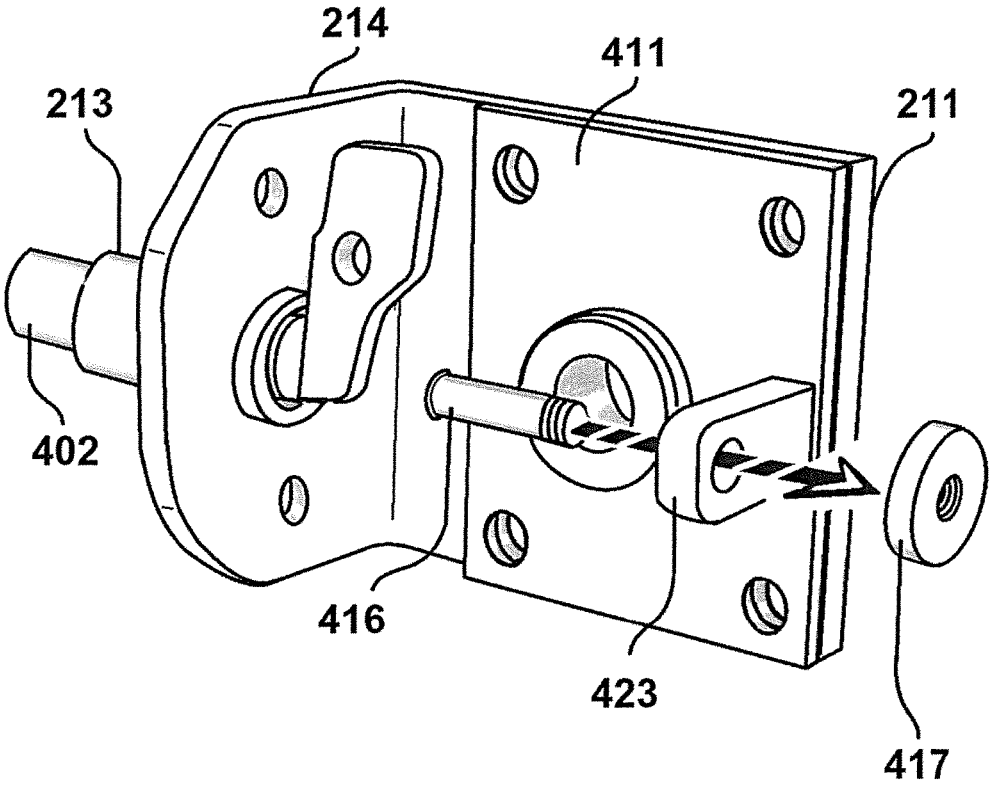
FIG. 22 illustrates the latch bolt, automatic lock base and sliding lock pin as positioned on the striker assembly.
Figure 25:
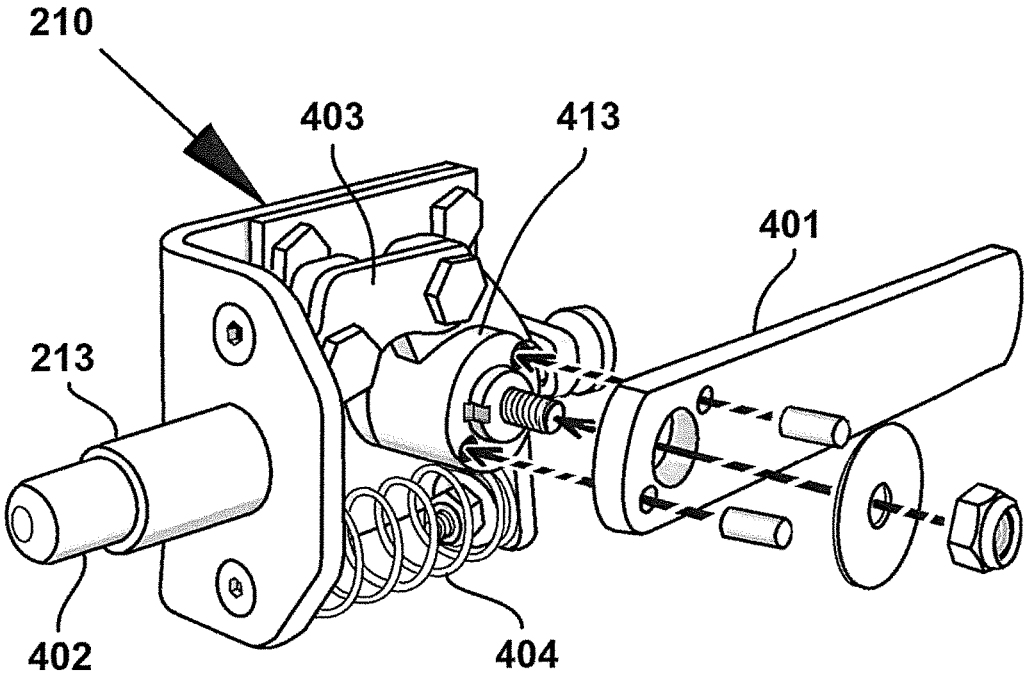
FIG. 25 illustrates automatic gate latch assembly showing a handle to hub engagement with drive pins positioned at 45 degrees.

In a preferred embodiment the manual gate latch assembly 300 further comprises latch bolt handle screw 308 mounted into an apertured latch bolt handle flange 312, the latch bolt handle screw 308 extending perpendicular relative to the axis of the latch bolt 301. The latch bolt handle screw 308 may be inserted through either side of the latch bolt handle flange 312 (FIGS. 15 and 20) to accommodate either right opening or left opening gates 10. The latch bolt handle screw 308 and flange 312 serve multiple purposes. The latch bolt handle screw 308 serves as a handle to reciprocate the latch bolt 301. The latch bolt handle flange 312 limits movement of the latch bolt 301 in the retraction direction by abutting the paddle bolt 310 (FIG. 11B). The latch bolt handle bolt 308 passes through the latch bolt handle flange 312 and abuts the striker base plate 211 of the striker assembly 210, such that the angle of the L-shaped handle 302 may be rotated inward or outward to properly align the lock receiving bore 303 with the apertured paddle bolt 310, as shown in FIGS. 17A and 17B.

For additional security, one of the mounting apertures for the latch bolt assembly base plate 305 is provided with a non-circular screw receptacle 311, such as raised square walls, and one mounting screw 309 has a non-circular head that conforms with the non-circular screw receptacle 309 (FIG. 18A), such that when fully inserted the non-circular head of mounting screw 309 cannot rotate within the non-circular screw receptacle 311. To mount the bolt catch member 304 onto the latch post 12, the base plate 305 is rotated to drive the mounting screw 309 into the latch post 12, thereby precluding easy removal of the bolt catch member 304.

In still another embodiment, as shown in FIGS. 21 through 32, the gate lifter latch is shown in combination with an automatic gate latch assembly 400 affixed to the striker assembly 210. The automatic gate latch assembly 400 may comprise single or double handles 401, as shown best in FIG. 21. The automatic latch bolt assembly 400 further comprises a latch bolt 402, a connector linkage 403 extending between the bolt flange 419 of the latch bolt 402 and the hub flange 421 of the hub member 413, the handle or handles 401 being mounted to the hub member 413, and a spring member 404 which maintains the latch bolt 402 in the extended position unless the handle 401 is rotated to retract the latch bolt 402.

The latch bolt 402 passes through the hollow striker pin 213 and into a bolt catch member 405 having a base plate 406, a bolt flange 407 extending from the base plate 406, and a bolt receiving aperture 408. Because the latch bolt 402 is biased in the extended position by the spring member 404 when the gate 10 is being closed, for an inswing gate 10 as seen in FIGS. 27B and 28B, the free end of the bolt flange 407 is preferably provided with an angled or curved ramp surface 409 such that the end of the latch bolt 402 will first strike the ramp surface 409 when the gate 10 is closed. For an outswing gate 10, as seen in FIGS. 27A and 28A, bolt flange 407 itself is angled or curved. The ramp surface 409 or ramped flange 407 pushes the latch bolt 402 a short distance into the striker pin 213 until the latch bolt 402 aligns with the bolt receiving aperture 408, whereupon it is again fully extended by the spring member 404.

Figure 26A:
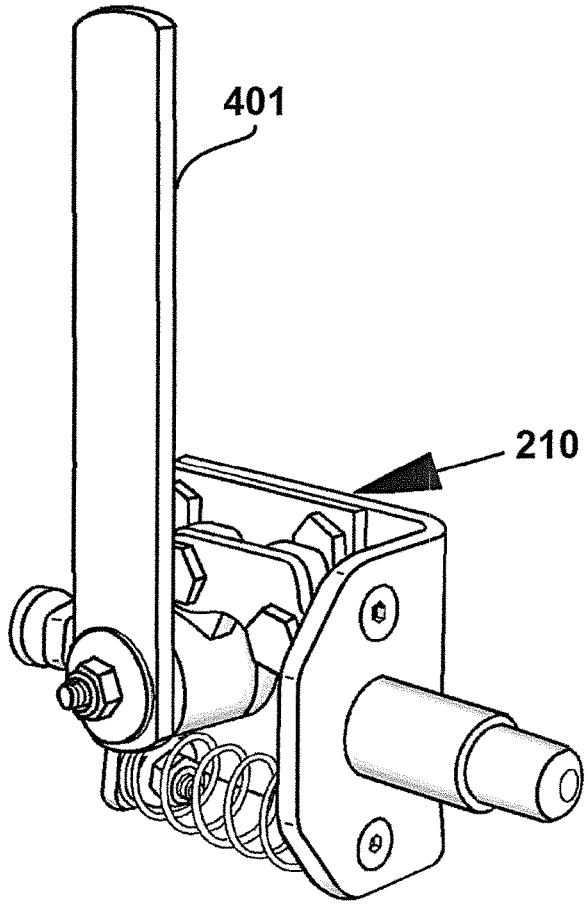
FIGS. 26A and 26B illustrate a fully assembled, single handle, automatic gate latch assembly showing the handle in the vertical and the horizontal orientation.
Figure 26B:
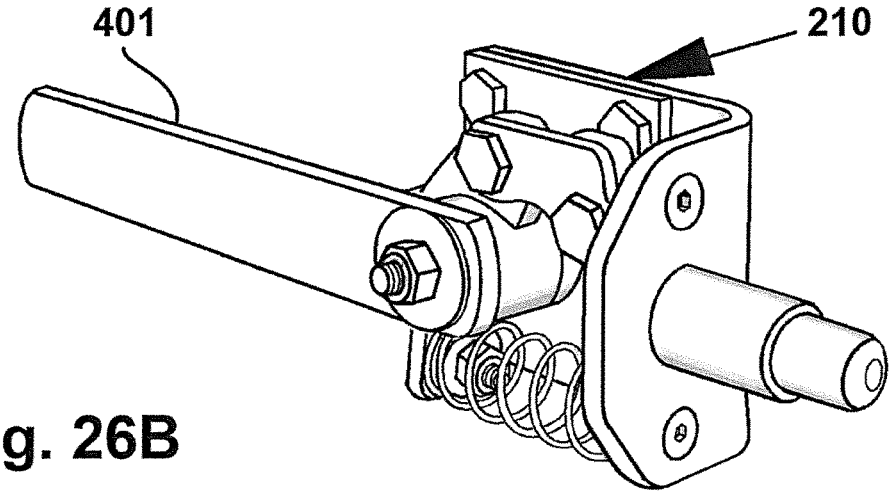
Figure 30:
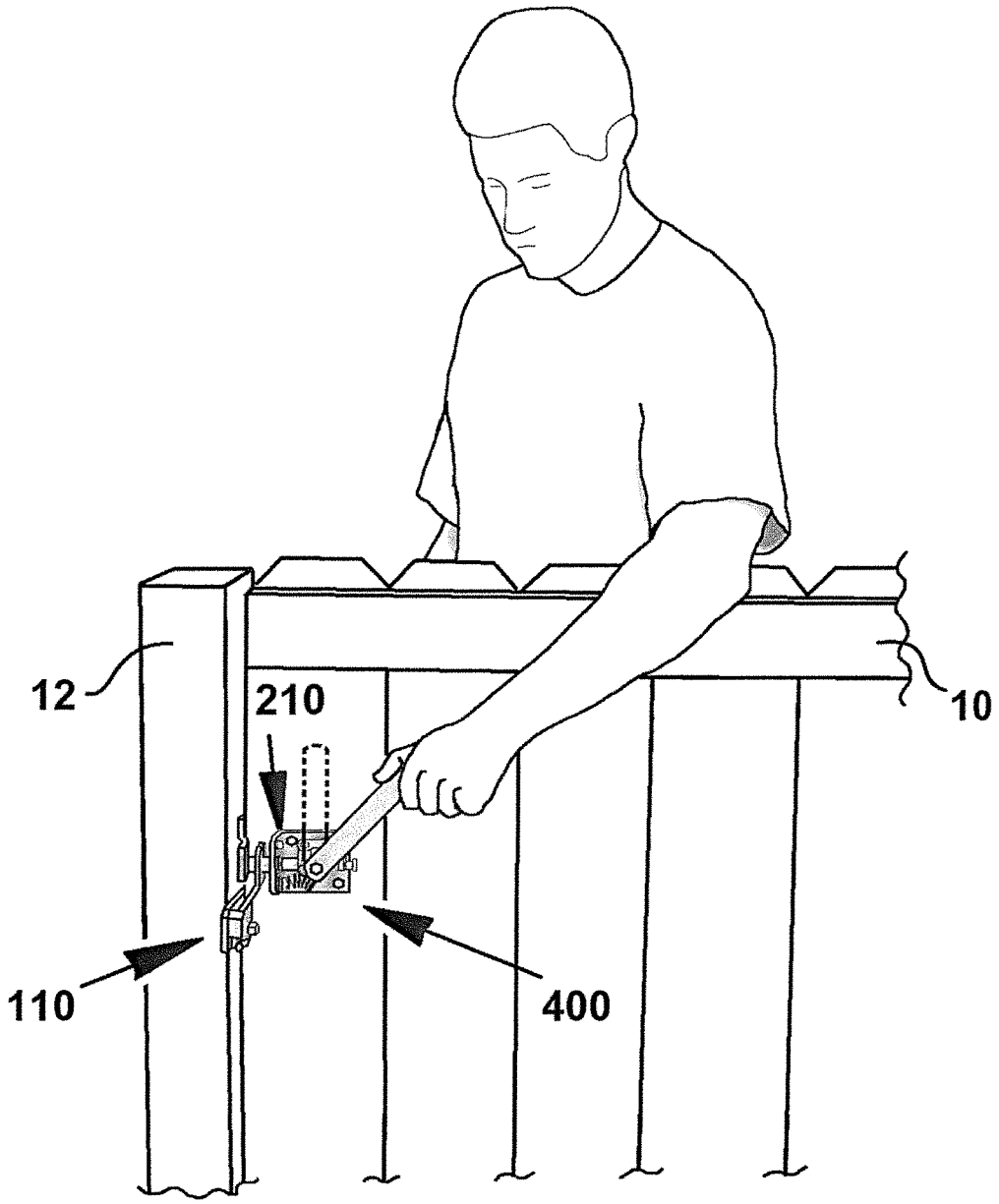
FIG. 30 illustrates the opening of an inner, vertically oriented handle embodiment of the gate lifter latch automatic gate latch assembly wherein the user is on the outside of the gate.
Figure 31:
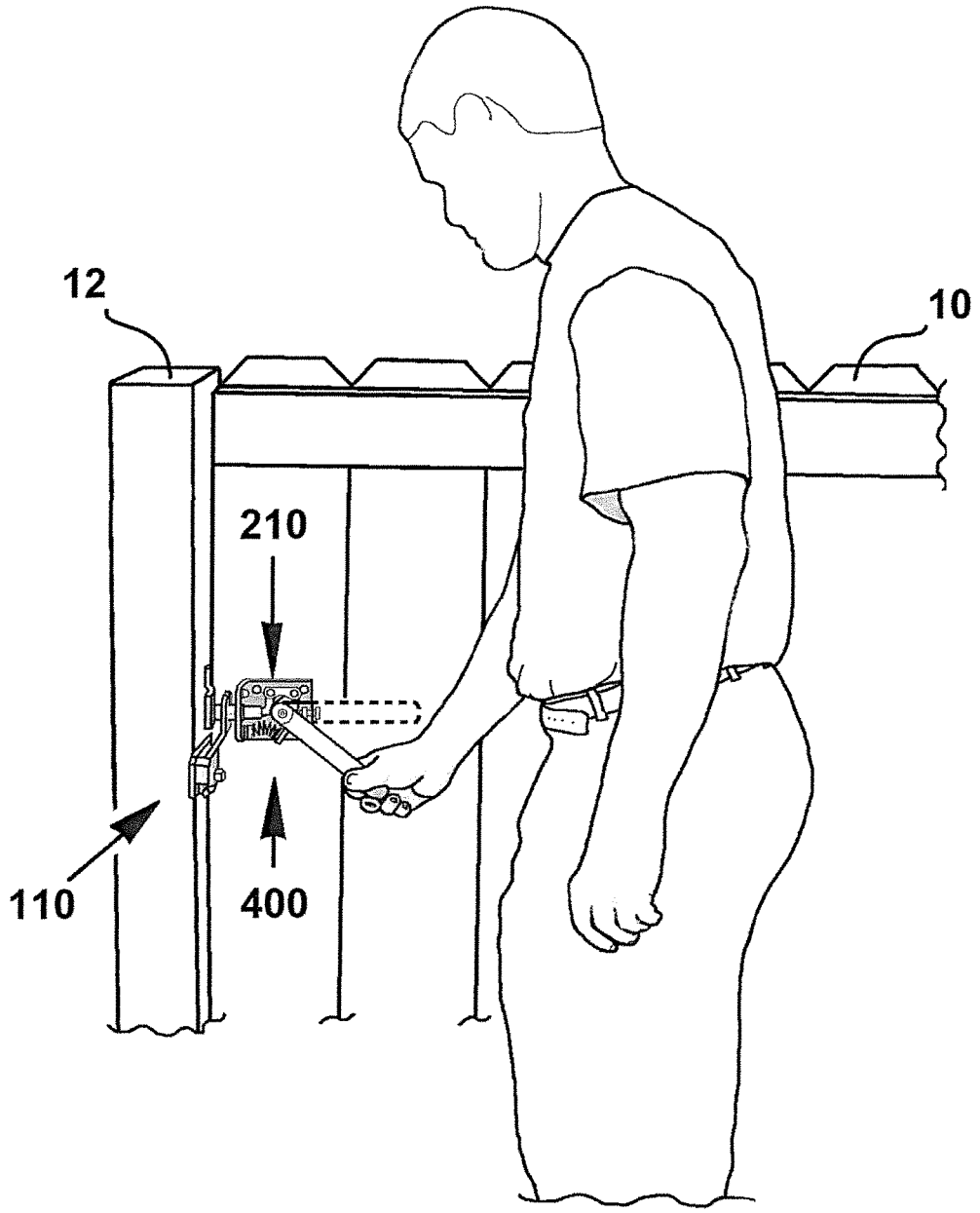
FIG. 31 illustrates the opening of an inner, horizontally oriented handle embodiment of the gate lifter latch automatic gate latch assembly wherein the user is on the inside of the gate.
Figure 32:
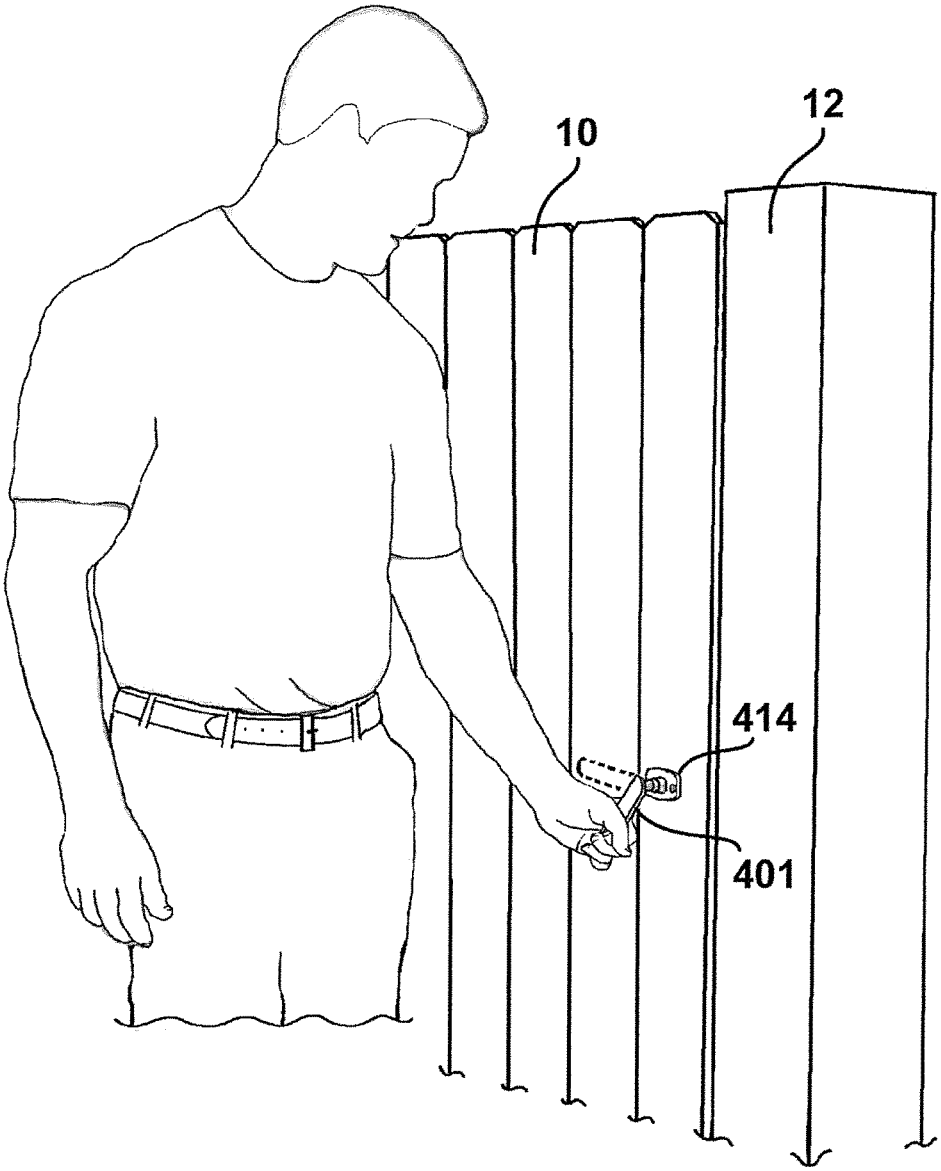
FIG. 32 illustrates the opening of an outer, horizontally oriented handle embodiment of the gate lifter latch automatic gate latch assembly wherein the user is on the outside of the gate.

An automatic lock base member 411 is coextensively mounted to the striker base plate 211 of the striker assembly, both the automatic lock base member 411 and the striker base plate 211 having aligned mounting apertures and a relatively large central opening which retains a bushing 415 through which the drive shaft 412 extends. The handle 401 and the hub member 413 are apertured (FIG. 25) such that the handle 401 may be mounted either vertically (FIG. 26A) or horizontally (FIG. 26B). The spring member 404 extends between a spring mount 422 positioned on the hub member 413 and a nut located on the striker pin flange 214 of the striker assembly 210.

The central axis of the drive shaft 412 and hub member 413 of the automatic gate latch assembly 400 preferably intersect the longitudinal axis of the latch bolt 402 such that the assembly 400 is reversible to accommodate both left opening and right opening gates 10, as shown in FIGS. 23A and 23B.

The automatic gate latch assembly 400 also preferably comprises a sliding lock pin 416 that extends through the aperture of a pin flange 423 extending outwardly from the automatic lock base 411. The lock pin 416 is secured with a lock pin head 417 (FIG. 22) and is aligned on the longitudinal axis of the latch bolt 402. With the lock pin 416 advanced toward the hub member 413 when the latch bolt 402 is extended, the hub shoulder 424 of the hub member 413 is precluded from rotating to withdraw or retract the latch pin 402, thereby locking the gate 10, as shown in FIG. 24A. To unlock the automatic gate latch assembly 400, the lock pin 416 is retracted such that the hub member 413 such that the hub member 413 and handle 401 are free to be rotated to retract the latch bolt 402, as shown in FIG. 24B.

It is understood that equivalents and substitutions for come elements set forth above may be obvious to those of ordinary skill in the art, and therefore the true scope and definition of the invention is to be as set forth in the following claims.

I claim:

1. A gate lifter latch comprising:

a catch lifting assembly and a striker assembly;

said striker assembly comprising a striker pin;

said catch lifting assembly comprising a lifter base plate, a pivoting lift arm member pivotally mounted to said lifter base plate, a lift arm inclination adjusting assembly determining the lowermost position of said lift arm member, and a stop member limiting movement of said lift arm member;

whereby with said striker assembly mounted to a gate and said catch lifting assembly mounted to a latch post, said striker pin is received by said lift arm member during closure of the gate;

and further whereby upon sagging of the gate, said lift arm member raises the gate during closure of the gate.

2. The gate lifter latch of claim 1, wherein said lift arm member comprises an open slot sized to receive said striker pin therein.

3. The gate lifter latch of claim 1, wherein said lift arm inclination assembly determines the pivot range of said lift arm member.

4. The gate lifter latch of claim 1, wherein said lift arm member pivots between a vertical position and a horizontal position.

5. The gate lifter latch of claim 1, wherein said lift arm and said lifter base plate are structured such that said lift arm may be mounted to either side of said lifter base plate.

6. The gate lifter latch of claim 1, further comprising a manual gate latch assembly comprising a latch bolt and bolt catch member.

7. The gate lifter latch of claim 1, further comprising an automatic gate latch assembly comprising a latch bolt and bolt catch member.

8. The gate lifter latch of claim 1, wherein said gate lifter latch is structured such that said gate lifter latch may be disassembled and reassembled for use on a right inswing gate, a left inswing gate, a right outswing gate or a left outswing gate.

9. A gate lifter latch comprising:

a catch lifting assembly and a striker assembly;

said striker assembly comprising a striker pin mounted to a striker base plate, said striker base plate adapted to be mounted to a gate on its free end;

said catch lifting assembly comprising a pivoting lift arm member comprising an open slot, said lift arm member pivotally mounted to a lifter base plate, a lift arm inclination adjusting assembly determining the lowermost position of said lift arm member, and a stop member limiting movement of said lift arm member, said catch lifting assembly adapted to be mounted to a latch post;

whereby with said striker assembly mounted to the gate and said catch lifting assembly mounted to the latch post, upon closure of the gate said striker pin is received within said open slot of said lift arm member and said lift arm member pivots into a substantially vertical position; and further whereby upon sagging of the gate, said lift arm member raises the gate during closure of the gate.

10. The gate lifter latch of claim 9, said lift arm inclination assembly determines the pivot range of said lift arm member.

11. The gate lifter latch of claim 9, wherein said lift arm and said lifter base member are structured such that said lift arm may be mounted to either side of said lifter base member.

12. The gate lifter latch of claim 9, further comprising a manual gate latch assembly comprising a latch bolt and bolt catch member.

13. The gate lifter latch of claim 9, further comprising an automatic gate latch assembly comprising a latch bolt and bolt catch member.

14. The gate lifter latch of claim 9, wherein said gate lifter latch is structured such that said gate lifter latch may be disassembled and reassembled for use on a right inswing gate, a left inswing gate, a right outswing gate or a left outswing gate.

15. A gate lifter latch comprising:

a catch lifting assembly and a striker assembly;

said striker assembly comprising a striker pin mounted to a striker base plate, said striker base plate adapted to be mounted to the free end of a gate;

said catch lifting assembly comprising a pivoting lift arm member comprising an open slot, said lift arm member pivotally mounted to a lifter base plate, and a stop member limiting movement of said lift arm member, said catch lifting assembly adapted to be mounted to a latch post;

said catch lifting assembly further comprising a lift arm inclination adjusting assembly, said lift arm inclination adjusting assembly determining the lowermost position of said lift aim member;

whereby with said striker assembly mounted to the gate and said catch lifting assembly mounted to the latch post, upon closure of the gate said striker pin is received within said open slot of said lift arm member and said lift arm member pivots into a substantially vertical position; and further whereby upon sagging of the gate, said lift arm member raises the gate during closure of the gate.

16. The gate lifter latch of claim 15, further comprising a manual gate latch assembly comprising a latch bolt and bolt catch member.

17. The gate lifter latch of claim 15, further comprising an automatic gate latch assembly comprising a latch bolt and bolt catch member.

* * * * *